US008413809B2

(12) United States Patent
Koch et al.

(10) Patent No.: US 8,413,809 B2
(45) Date of Patent: Apr. 9, 2013

(54) PACKAGING FOR SPECIALTY SHINGLE

(75) Inventors: Stephen A. Koch, Collegeville, PA (US); Robert L. Jenkins, HoneyBrook, PA (US); Husnu M. Kalkanoglu, Swarthmore, PA (US); Gregory F. Jacobs, Oreland, PA (US); Barbara A. McDonough, Gilbertsville, PA (US); Paul J. Batt, Harleysville, PA (US)

(73) Assignee: CertainTeed Corporation, Valley Forge, PA (US)

( * ) Notice: Subject to any disclaimer, the term of this patent is extended or adjusted under 35 U.S.C. 154(b) by 606 days.

(21) Appl. No.: 12/425,496

(22) Filed: Apr. 17, 2009

(65) Prior Publication Data

US 2009/0272663 A1 Nov. 5, 2009

Related U.S. Application Data

(60) Provisional application No. 61/049,980, filed on May 2, 2008.

(51) Int. Cl.
*B65D 85/46* (2006.01)

(52) U.S. Cl.
USPC ..... 206/323; 206/324; 206/499; 206/321; 206/564; 206/507; 206/386; 206/595; 206/597; 206/598; 229/117.14; 229/117.13; 229/117.15

(58) Field of Classification Search ..... 206/323, 206/324, 499, 321, 564, 507, 386, 595, 597, 206/598; 229/117.14, 117.13, 117.15
See application file for complete search history.

(56) References Cited

U.S. PATENT DOCUMENTS

| | | | | | |
|---|---|---|---|---|---|
| 1,798,612 | A * | 3/1931 | Malcolmson | 206/167 |
| 1,981,647 | A * | 11/1934 | Johnson | 206/766 |
| 2,133,683 | A * | 10/1938 | Black | 52/748.1 |
| 2,259,962 | A * | 10/1941 | Owen | 52/276 |
| 2,340,422 | A * | 2/1944 | Okonski | 206/321 |
| 3,011,631 | A * | 12/1961 | Sider | 206/323 |
| 3,094,211 | A * | 6/1963 | Bender | 206/386 |
| 3,339,721 | A * | 9/1967 | Goldstein | 206/583 |
| 4,856,652 | A * | 8/1989 | Bowland | 206/223 |
| 5,462,221 | A | 10/1995 | Zink et al. | |
| 5,467,915 | A | 11/1995 | Mattson | |
| 6,367,627 | B2 | 4/2002 | Freiborg | |
| 6,547,126 | B2 * | 4/2003 | Freiborg et al. | 229/120.17 |
| 6,980,934 | B1 * | 12/2005 | Sadovnik | 703/1 |
| 2007/0144077 | A1 | 6/2007 | Quaranta et al. | |
| 2007/0267306 | A1 | 11/2007 | Jenkins et al. | |

* cited by examiner

*Primary Examiner* — J Gregory Pickett
*Assistant Examiner* — Blaine Neway
(74) *Attorney, Agent, or Firm* — Paul & Paul

(57) ABSTRACT

A package of specialty shingles is provided, preferably for containing hip, ridge or rake shingles, with support in the bottom of the package for the shingles that is complementary to the lower ends of nested, stacked shingles in the package. Shaped constraining devices are provided, for retaining the shape of shingles in the package. An assembly of packages of the specialty shingles is provided, in a tray arrangement, and a pallet assembly of various levels of such packages disposed on a pallet are also provided.

14 Claims, 24 Drawing Sheets

Figure 1B:
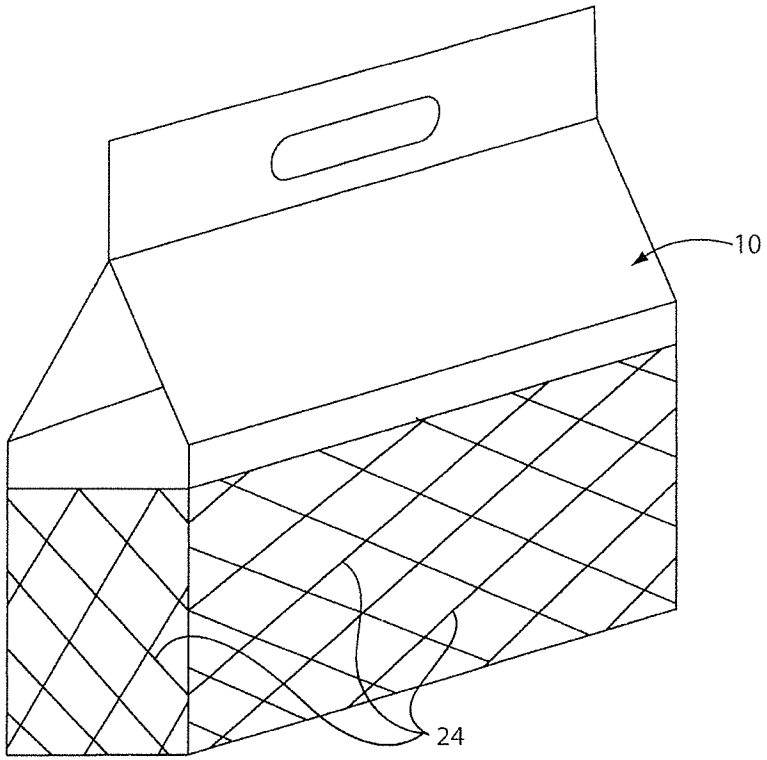

63
62

64
53
55
50
57
60
60'
54

58
61
61'
52
56
51
53

50
63
62
64
53
55
54
52
56
57
58
60
61
65

50
66
63
62

50
66
64
53
55

57
60
58
61
50
56
66
52
54

50
60'

50
90
63
62

59
72
82
86
73
74
70
89
85
78
79
75
80
71
84
88
81

76
77
83
87
50
60'
52
60
61
61'
54

93
92
91
99

93
91
92
99

93
91
92
94
99
94

93
91
90
92

135
130
138

136
132
136
130
132

137
132
131
134
135
130
133
136

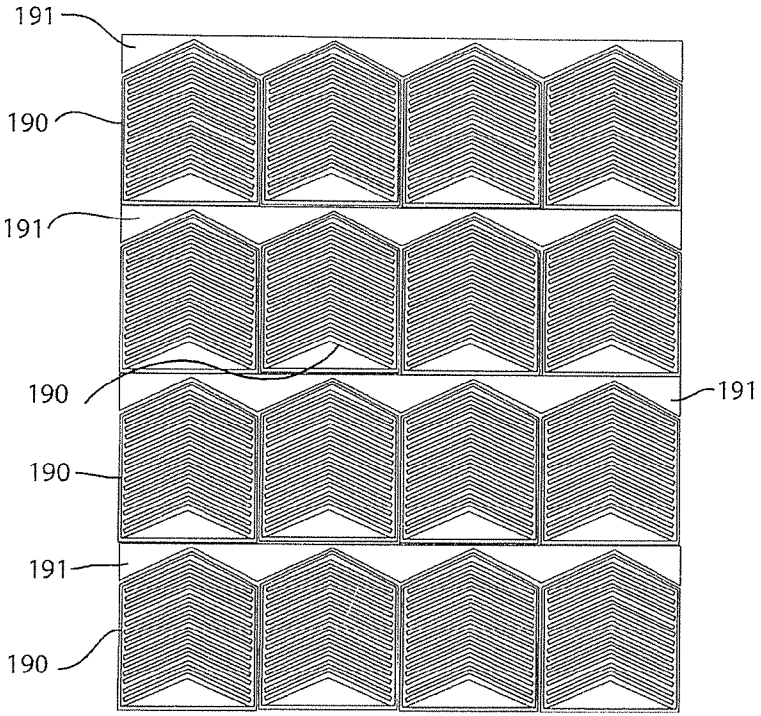
Fig. 17
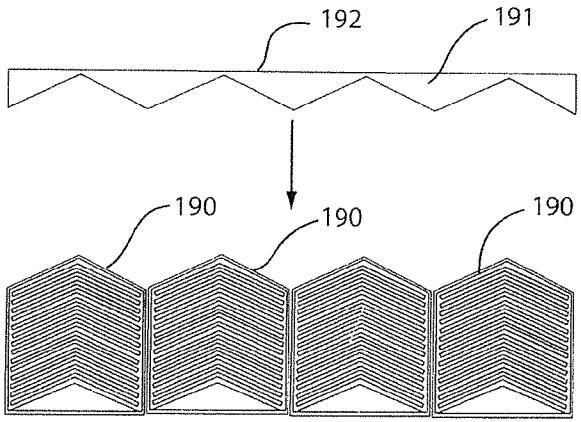

PACKAGING FOR SPECIALTY SHINGLE

CROSS-REFERENCE TO RELATED APPLICATIONS

This application claims priority from U.S. provisional application Ser. No. 61/049,980 filed May 2, 2008, the complete disclosure of which is herein incorporated by reference.

BACKGROUND OF THE INVENTION

In the art of shingle manufacture, shingles are generally packaged in bundles, with a cardboard kraft paper, a liner layer, a plastic film or a corrugated paper-based material or like wrapping material disposed about a given number of shingles.

However, aside from the shingles that are conventionally used in roofing, it has become desirable to provide specialty shingles, such as for use along hips, ridges, or rakes of a roof, with such specialty shingles being generally smaller in size than conventional roofing shingles.

In some installations, conventional roofing shingles are cut apart to form smaller shingles that are used on hips, ridges or rakes of a roof. However, the use of such portions of shingles does not provide an appearance that is as ornamental, with a finished look, as can be provided by the use of specialty shingles that are made specifically for the purpose of being used on hips, ridges, and/or rakes of roofs.

It is also sometimes desirable that specialty shingles may have variations in thickness that have to be accommodated in packaging. It is also desirable that sometimes specialty shingles are provided with a three-dimensional aspect, such as being pre-folded or pre-bent to accommodate included angles where there are intersecting surfaces of hips, ridges, and/or rakes of a roof, so that the specialty shingles do not have to be bent or folded at the site of application where, depending upon temperature conditions, they might otherwise develop cracks if they are bent or folded at the site of application. Because the shingles are already folded into a "V"-shape (or inverted "V"-shape) the installation of these shingles on a roof can be more efficiently and more effectively accomplished.

Examples of the packaging of shingles having a three-dimensional aspect in accordance with prior art techniques are set forth, for example, in U.S. Pat. Nos. 6,367,627 and 6,547,126. Insert structures for supporting the pre-folded specialty roofing materials in a package are also known as set forth in published patent application US2007/0267306 A1.

It would be advantageous to have an improved packaging for specialty shingles that assists in maintaining the shape of pre-formed specialty shingles during storage and handling of bundles, is useful for transport of specialty shingles to the work site and from the ground to the rooftop work area, and is more environmentally friendly and makes more efficient use of packaging materials.

SUMMARY OF THE INVENTION

This invention provides an improved packaging system for use with specialty shingles, especially preformed shingle shapes for hip, ridge and rake edge applications. The packaging includes a wrap to contain a stack of such shingles and a means for constraining the package so that preformed shingle shapes are maintained in the desired geometry. The invention also includes a method of packaging a stack of specialty shingles for ease of transport and protecting the geometry of such shingles during transport and handling of the packaged shingles. This invention creates a unique packaging system for holding and delivering one or more layers and/or variable thickness roofing accessory or specialty roofing materials.

It is an object of this invention to provide packaging materials suitable for transport of specialty roofing shingles having a three-dimensional aspect to a worksite.

It is a further object of the invention for the packaging to provide convenient handleability for transport of a bundle of specialty roofing shingles from the ground to the roof for installation.

Another object of the invention is for the packaging to assist in maintaining the geometry and shape of the specialty roofing shingles having a three-dimensional aspect in the package.

Another object of the invention is for the packaging to be environmentally friendly through the economical use of packaging materials.

Yet another object of the invention is for the packaging to be made of materials incorporating recycled content.

It is a further object of this invention to provide a package of specialty shingles, the package containing a plurality of stacked specialty shingles, the stack having a top and a bottom, two opposing ends and two opposing sides, with the package comprising a packaging element having a bottom support wall beneath the stack of specialty shingles, and two side walls hingedly attached to opposing sides of the support wall, and a constraining means adapted to maintain the side walls adjacent sides of the stack of specialty shingles. In some aspects the specialty shingles have a three-dimensional shape and a support insert is provided beneath the stack of specialty shingles, the insert having a complementary or inverse shape adapted to fit and support the shape of the bottom of the stack of specialty shingles. In other aspects, the side walls extend above the stack of shingles contained therebetween and the walls are folded or otherwise brought together to form a handle means to provide a structure useful for lifting the stack of shingles in the package. In further aspects, the constraining means is selected from the group of banding, shrink wrapping and stretch wrapping. In still further aspects, the constraining means is printed or decorated with information relevant to the specialty shingle product contained within the package.

It is a yet another object of this invention to provide a package of specialty shingles, the package containing a plurality of stacked specialty shingles having a three-dimensional shape, the stack having a top and a bottom, two opposing ends and two opposing sides, the package comprising a packaging element having a support structure beneath the stack of specialty shingles, the structure having a complementary shape adapted to fit and support the three-dimensional shape of the bottom of the stack of specialty shingles, and a constraining means adapted to maintain the side walls adjacent sides of the stack of specialty shingles. In other aspects, the constraining means is selected from the group of banding, shrink wrapping and stretch wrapping. In further aspects, the package is equipped with a handle for easy transport.

In one aspect, a group of or number of similarly shaped pieces for a roofing hip and ridge product are stacked and wrapped or covered around on two sides by a fixed length of material so as to contain or capture the desired roofing material. Packaging material such as cardboard, corrugated material or other organic or non-organic material is employed, such that two opposing sides of a four sided stacked product are covered and the remaining two sides are not covered and left open. An exemplary specialty shingle roofing hip and ridge product to be stacked and packaged is disclosed, for example, in published US patent application US2007/0144077A1, the entirety of which is incorporated herein by reference.

In another aspect, the ends of the packaging material after wrapping around the stacked roofing hip and ridge product come together and extend above the package of stacked shingles and form a handle or hinged connection with a shaped cut open area through which to insert fingers so as to grasp and pick up the stack of shingles. The handle or hinge enables lifting or movement of the entire assembly as one unit for lifting or handling of the stack of shingles as a unit.

In another aspect, the top portion of the wrapping material extending beyond the top of the stack of shingles is folded so as to form a square or flat top portion with a shaped or cut open area to function as a handle for lifting the package. The handle cutout areas may be located in the vertical side portions of the package, or, alternatively, in the horizontal top portion of the package, for insertion of fingers or a portion of the hand to lift the package.

In another aspect, a prefabricated handle is assembled with the package.

A further aspect of the invention includes a support to aid in maintaining the shape of a pre-shaped specialty shingle in the package. In this aspect, the wrapped portion of the packaging includes the addition of a preformed piece inserted or shaped or formed as part of the wrapping material so as to form an inverted "V" or similar shape that the stacked hip and ridge product can use to maintained a preformed, applicator friendly, shape that will accommodate a traditional shingle roof having two inclined sides with a common ridge-connecting location. Further exemplary inserts are disclosed in US patent application US20070267306A1, the entirety of which is herein incorporated by reference.

In yet another aspect, the packaging for a specialty roofing product has a side opening to allow easy quick access to roofing accessory or specialty roofing materials contained within as an additional time saving in labor. Such an opening may encompass a part of the area of at least one side of the packaging material, or, alternatively, may even encompass an entire side of the structure of the package for specialty shingles. In some configurations, a pre-perforated section is included as a part of the packaging that can be removed by the applicator as necessary upon opening.

In one aspect, the packaging is structured so as to allow hip and ridge shingles, roofing accessory or specialty roofing material to keep or maintain a pre-folded angle once inserted in the packaging box, if desired. In other aspects, the packaging may also be structured or formed to allow such hip and ridge shingles, roofing accessory or specialty roofing material to be laid flat if required by product design.

One aspect of the invention is individual packages of specialty roofing material each with a carrying handle for the package. The handle allows easy carrying on a level or inclined surface or on a ladder with one hand so as to free the other hand for safety.

In one aspect, the packaging handle is fit in between or is inserted between the two inner sides of two further package boxes in an overlying layer of boxes when the packages are stacked, as for example in a pallet of packages. This nesting of handles and boxes provides for integral support and interlock when palletized. The rigidity or stiffness acts to minimize deformation of the box assembly with reasonable weight when stacked. In an alternative arrangement, it may be desirable to intentionally fold down the upper handle to aid in stacking of boxes in a compact manner. In some instances slip sheets are employed between adjacent layers of packages in a stack or pallet. Also, in some instances adhesives between layers may be employed to assist in the stability of the pallet or stack.

In certain aspects, a constraining means is provide to add stability and structural integrity to the package. In one such aspect, a strap or band is wrapped around the package of stacked shingles, thereby assisting in constraining the pre-shaped specialty shingles therein and helping to protect the shingles in their desired form prior to use. In some situations, it may be desirable to band a plurality of packages together as a unit.

In yet another aspect, a box tray is included as part of the packaging. A partial height box section is provided to receive two or more individual packages of specialty shingles to contain the packages as a group. The use of a partial height tray conserves packaging material usage relative to the use of a full box package. In some instances, an overwrap is provided to wrap the tray and included package(s) (either partial or wholly) with a band, wrap, stretch wrap, shrink wrap or other material so as to give integrity to the whole packaging for palletizing and handling. Such a wrap may be used with individual packages as a constraining means for retaining the shape of the package and protection of the shape of pre-shaped specialty shingles. Such a wrap may also be used to group two or more packages, or a pallet of packages, for ease of handling and storage as a unit.

Preferred materials for the packaging box and tray include cardboard, coated or uncoated, corrugated or non-corrugated, or similar wood fiber, or layered paper-like material either of solid or hollow design. The material of may be of continuous or discontinuous design, for example, sheet-like or net-like, and may optionally be fiber reinforced. Other combinations of useful materials include but are not limited to recycled or virgin plastics such as, polyester, polyvinylchloride, polyolefins, biaxially oriented polypropylene, or similar materials. Other materials such as textile fabric or thin gauge lightweight metal, or foamed material, air cushioned or any reasonably stiff or board-like material may be employed.

In another aspect, a simplified packaging employs an appropriate gauge material of shrink or stretch or other means to contain a stack of specialty shingles. Stacks of specialty shingles are placed on a support form, for example, a triangularly shaped form having an inverted V-shape. A stretch wrap or shrink wrap is applied to constrain the stack of shingles on its support form. An optional carrying handle is attached to the stacked bundle. In another aspect, a metal or plastic band is used to constrain the stack of specialty shingles in a bundle on the support form. This aspect further reduces packaging material consumption and could be done with one or more stackable units together and without other materials such as cardboard, etc. while using a shaped triangular form underneath to maintain the product inverted V shape. Installation instructions, photographs or other marketing information could be added to the wrap film. Film color could be employed to differentiate between wrapped product types. In some aspects, this invention employs a tray on the bottom as described above and in more detail below. Palletization of the packages of this embodiment optionally include a custom slip sheet or insert between layers of a stack having inverted V-shape structures to match in a stackable/lockable location for multilayered integrity of the stacked pallet.

Other objects, aspects, and advantages of the present invention will be readily apparent from a reading of the following brief descriptions of the drawing figures, the detailed descriptions of the preferred embodiments, and the appended claims.

BRIEF DESCRIPTIONS OF THE DRAWING FIGURES

The following detailed description of the invention will be better understood when read in conjunction with the appended drawings. The accompanying drawings are not necessarily to scale, and sizes of various elements can be distorted for clarity. It should be understood that the invention is not limited to the precise arrangements and instrumentalities shown.

Figure 1A:
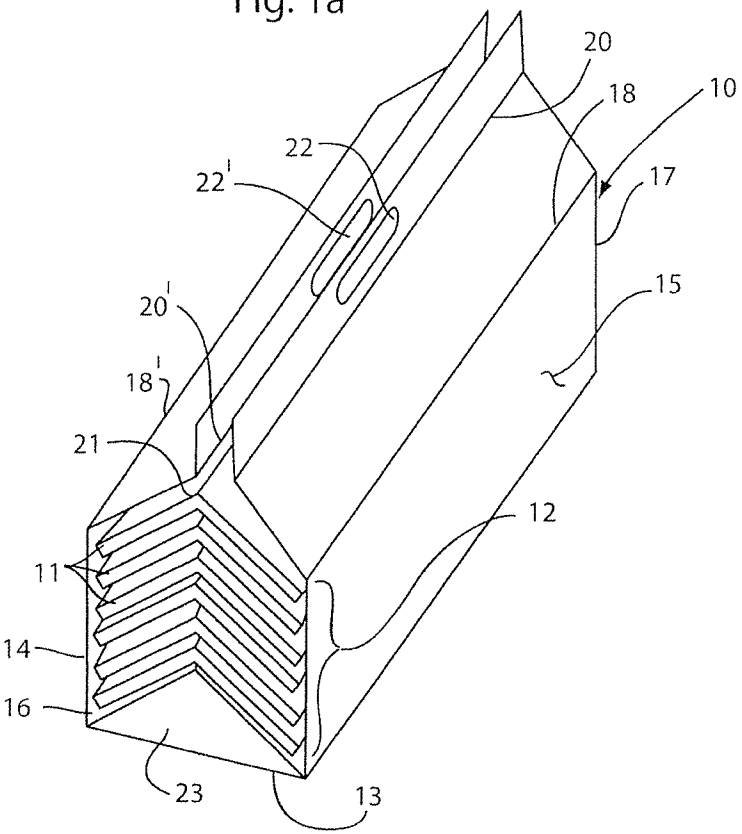

FIGS. 1*a* and 1*b* show perspective views of a package of specialty shingles according to embodiments of the present invention.

Figure 2B:
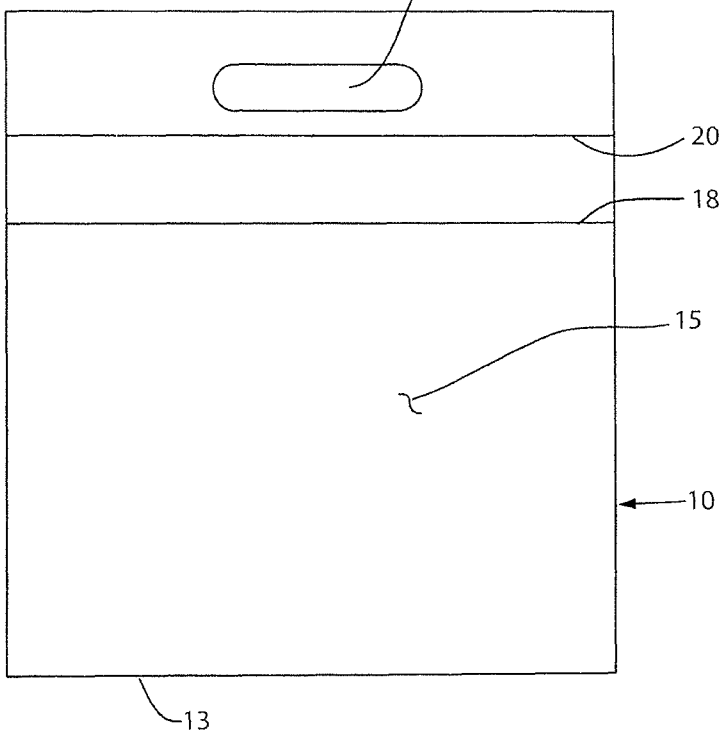
Figure 2A:
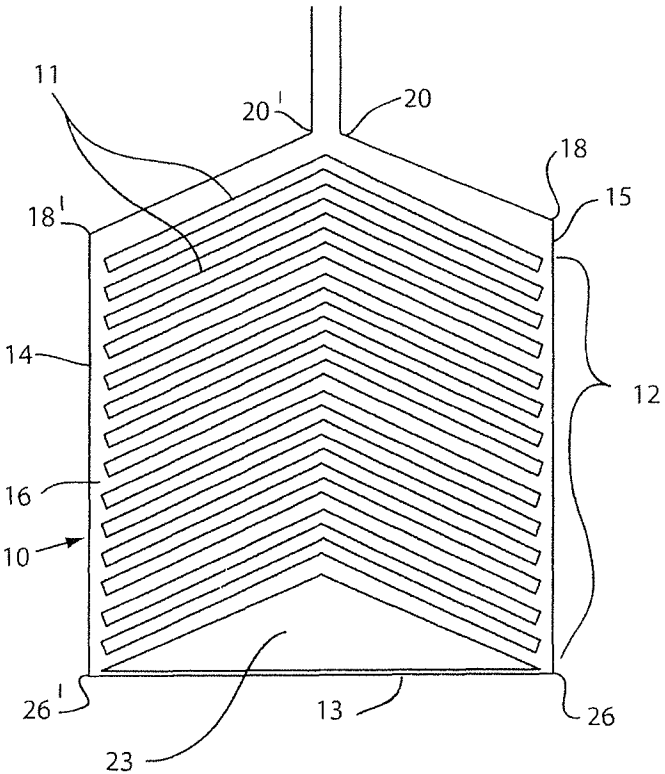

FIGS. 2*a* and 2*b* show end and side views, respectively, of a package of specialty shingles according to an embodiment of the present invention.

Figure 2C:
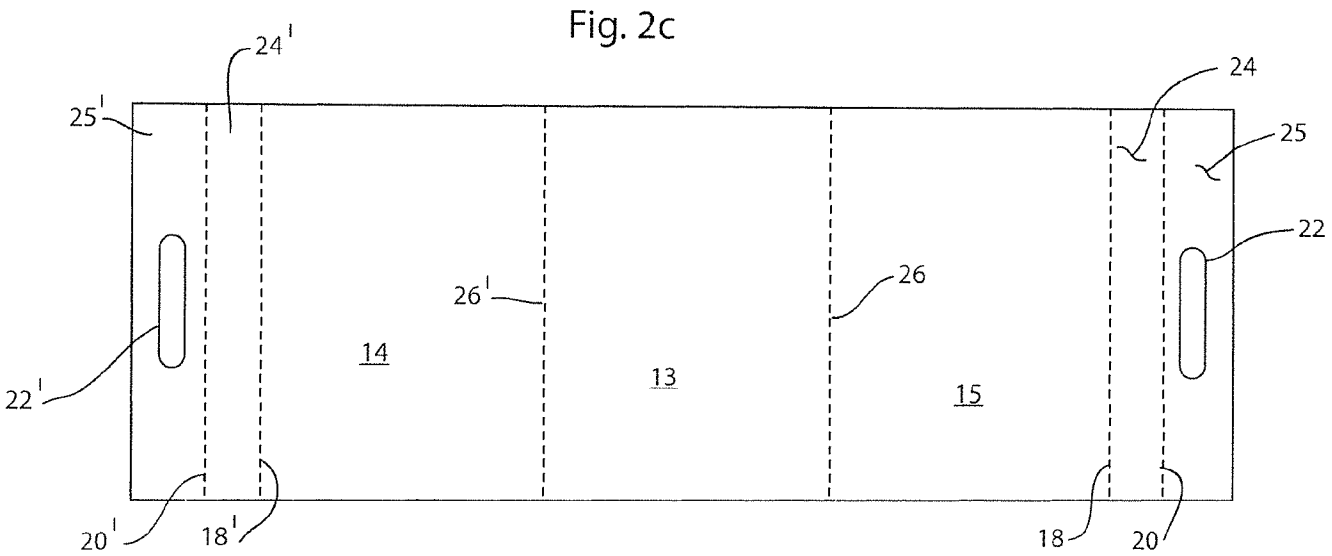

FIG. 2*c* shows a plan view of unassembled packaging of the invention shown in FIG. 2*a*.

Figure 2E:
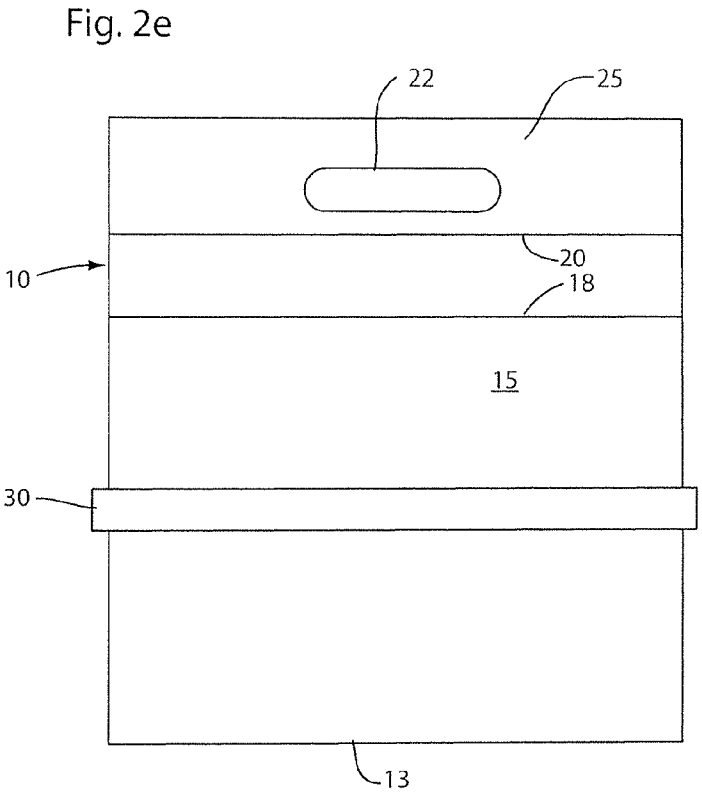
Figure 2D:
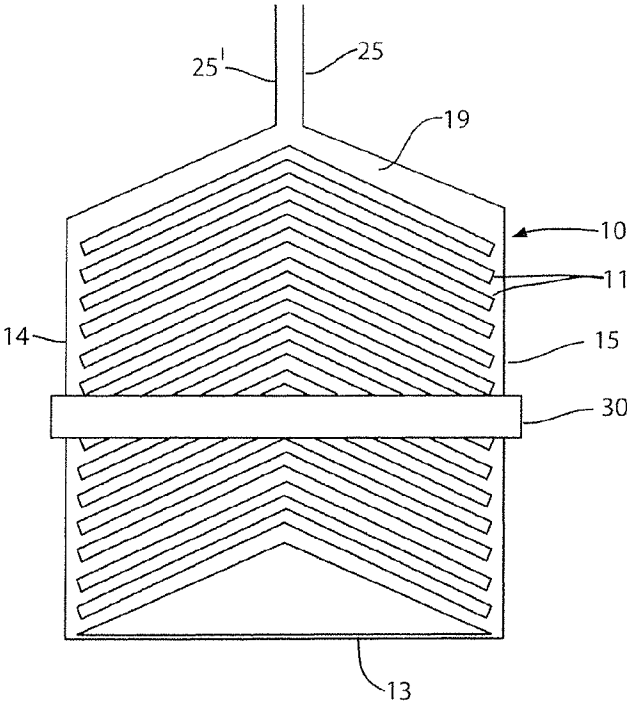

FIGS. 2*d* and 2*e* show end and side views, respectively, of a package of specialty shingles of FIGS. 2*a* and 2*b*, including a tension strap.

Figures 2F, 2G:
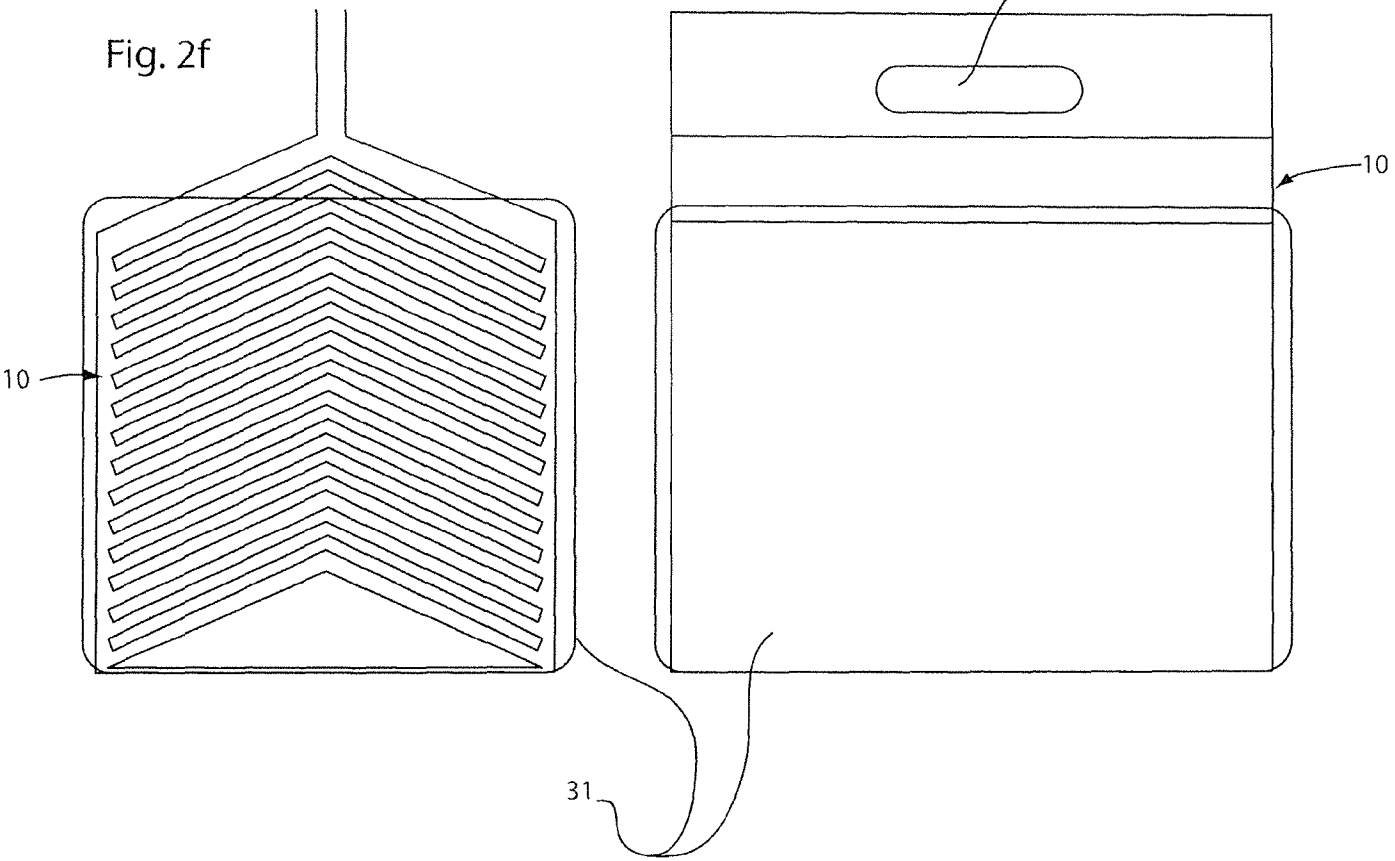

FIGS. 2*f* and 2*g* show end and side views, respectively, of a package of specialty shingles of FIGS. 2*a* and 2*b*, including a plastic wrap.

Figure 3B:
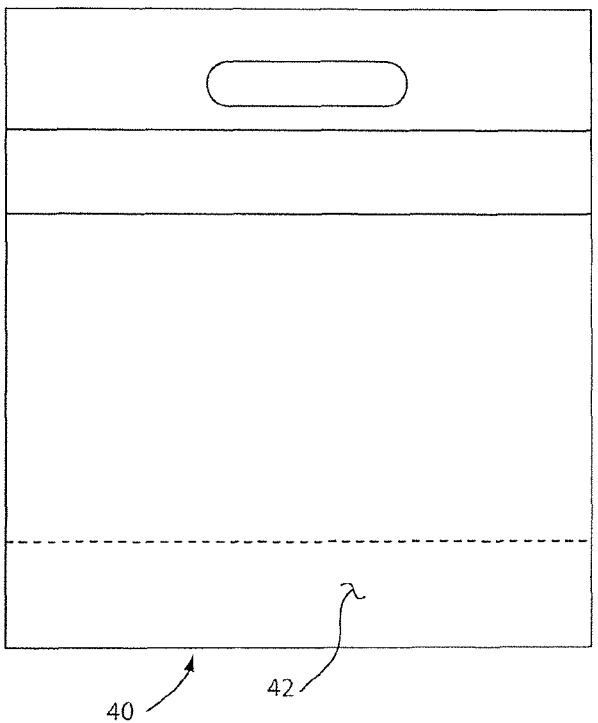
Figure 3A:
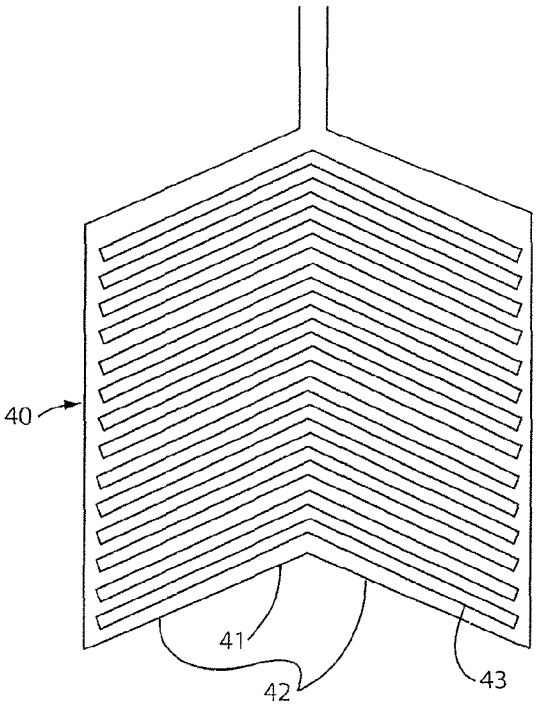

FIGS. 3*a* and 3*b* show end and side views, respectively, of a package of specialty shingles according to another embodiment of the present invention.

Figure 3D:
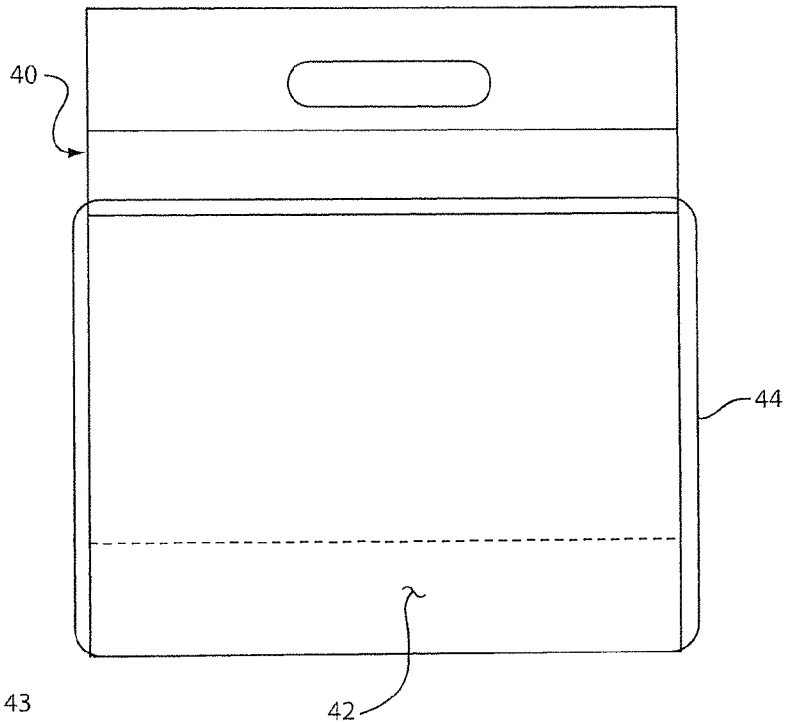
Figure 3C:
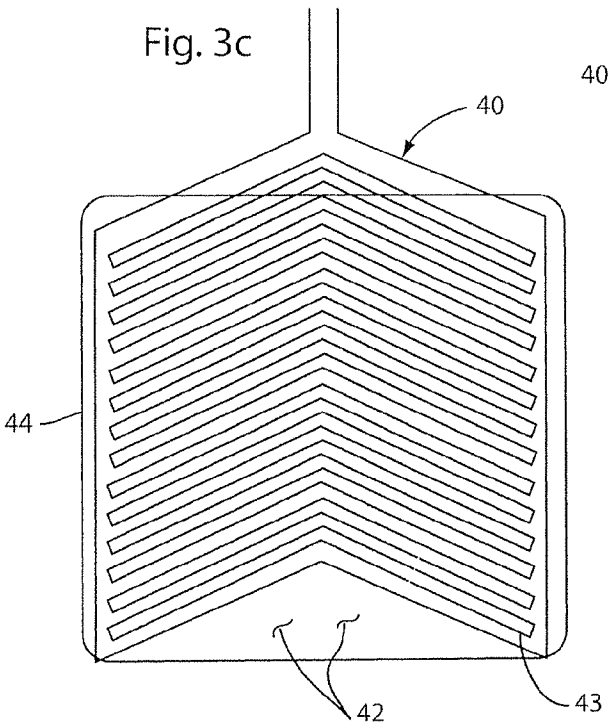

FIGS. 3*c* and 3*d* show end and side views, respectively, of a package of specialty shingles of FIGS. 3*a* and 3*b*, including a plastic wrap.

Figures 4A, 4B, 4C:
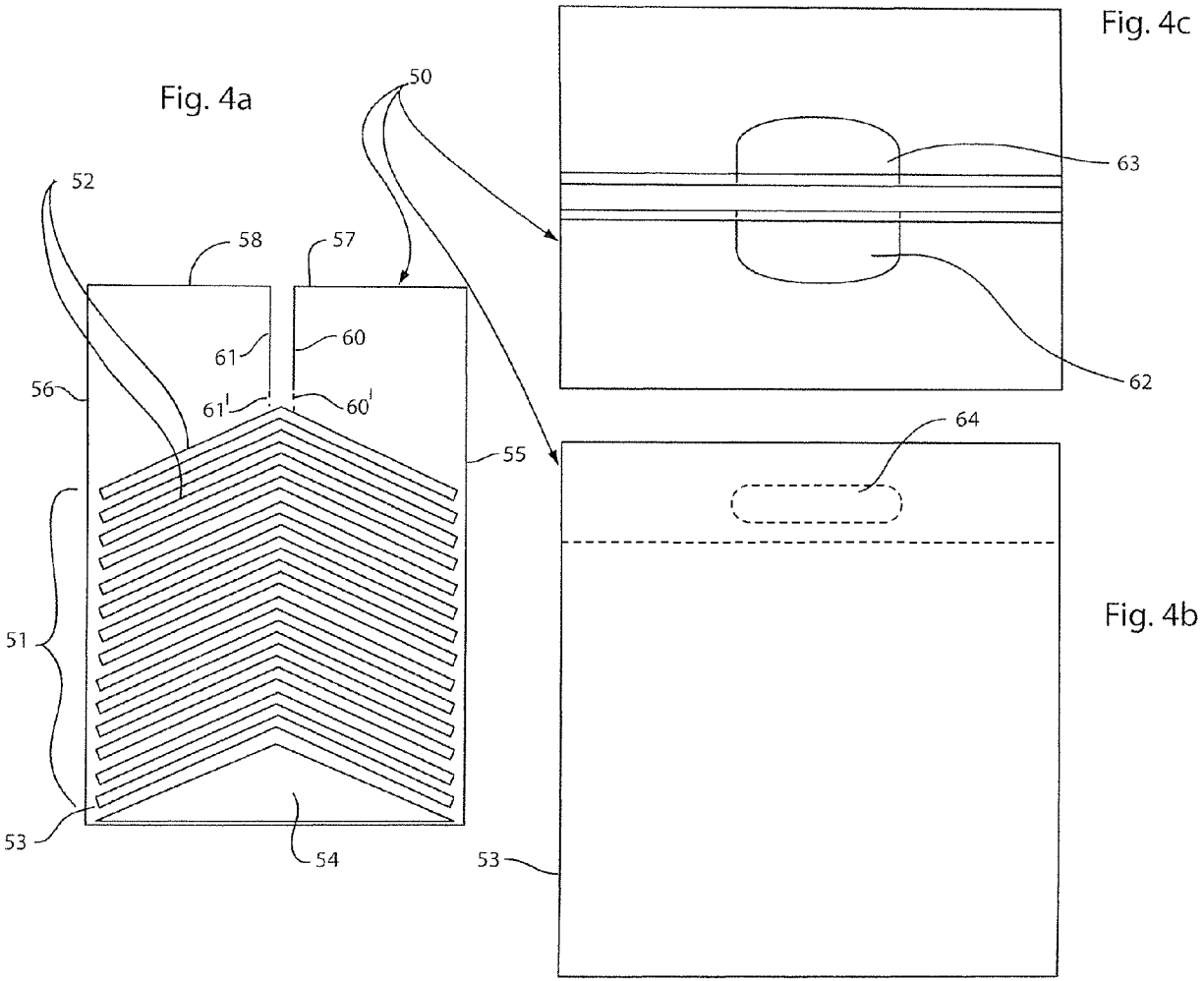

FIGS. 4*a*, 4*b*, and 4*c* show end, side, and top views, respectively, of a package of specialty shingles according to another embodiment of the present invention.

Figures 4D, 4E, 4F:
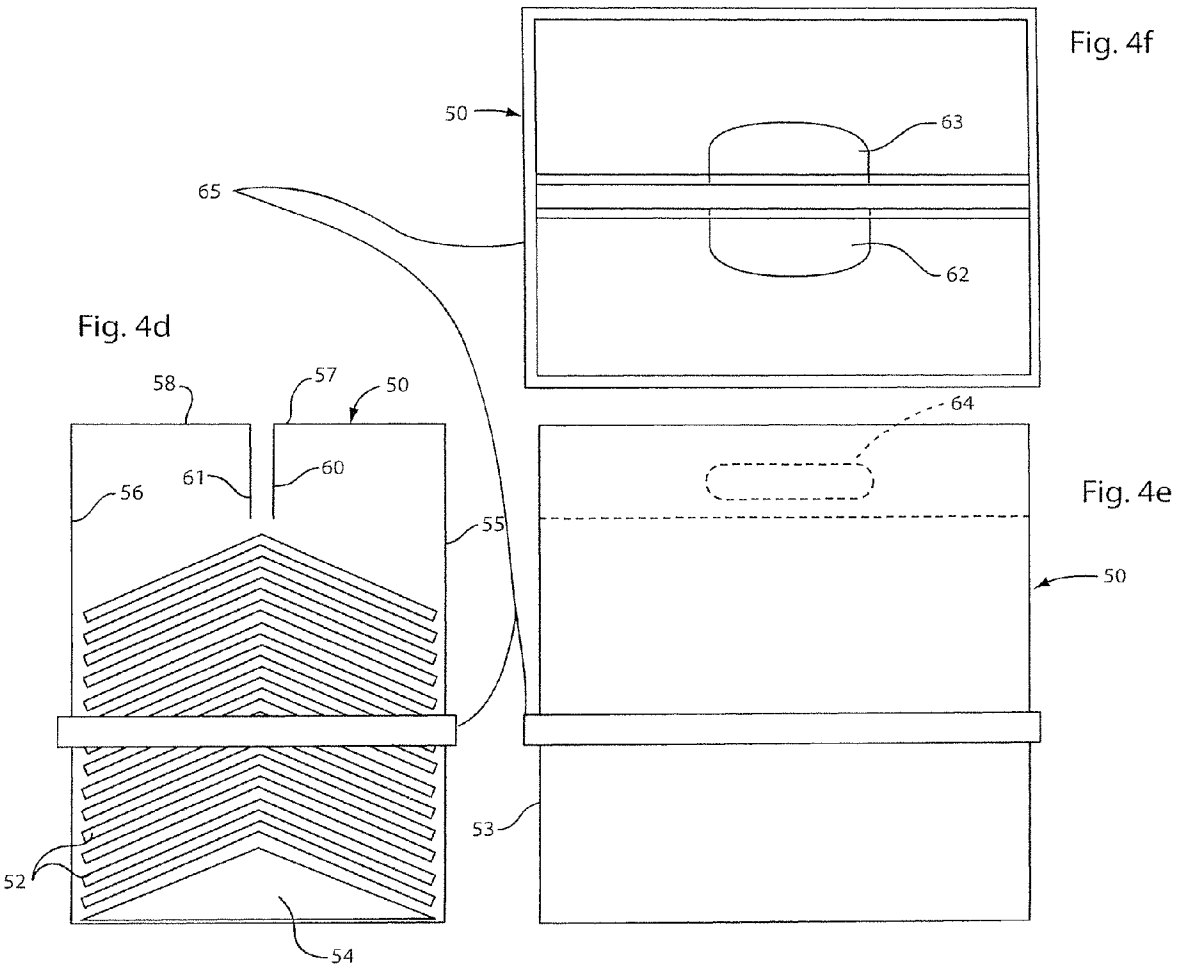

FIGS. 4*d*, 4*e*, and 4*f* show end, side and top views, respectively, of a package of specialty shingles of FIGS. 4*a*, 4*b*, and 4*c*, including a tension strap.

Figures 4G, 4H, 4I:
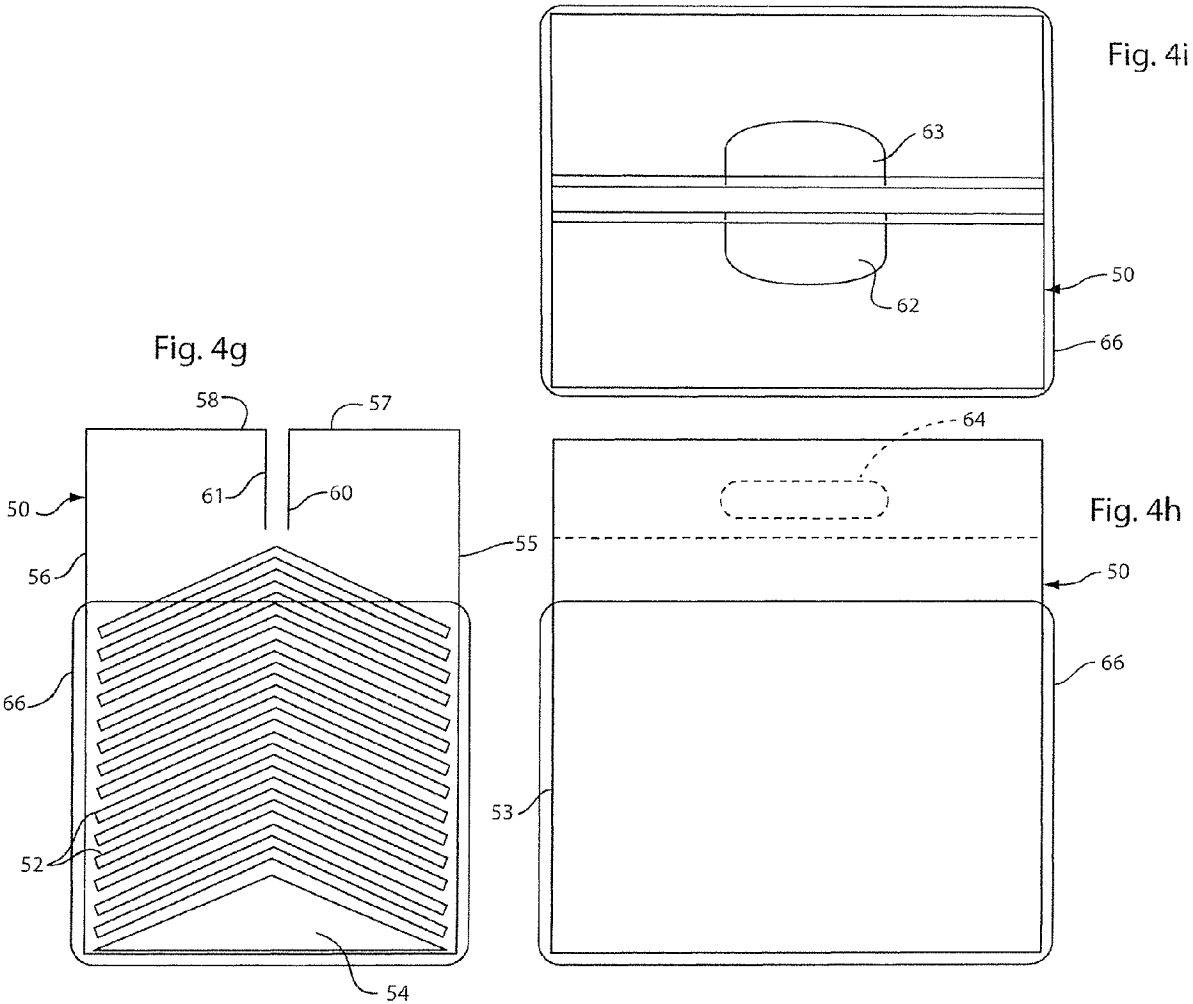

FIGS. 4*g*, 4*h*, and 4*i* show end, side and top views, respectively, of a package of specialty shingles of FIGS. 4*a*, 4*b*, and 4*c*, including a plastic wrap.

Figures 5A, 5B, 5C, 5D:
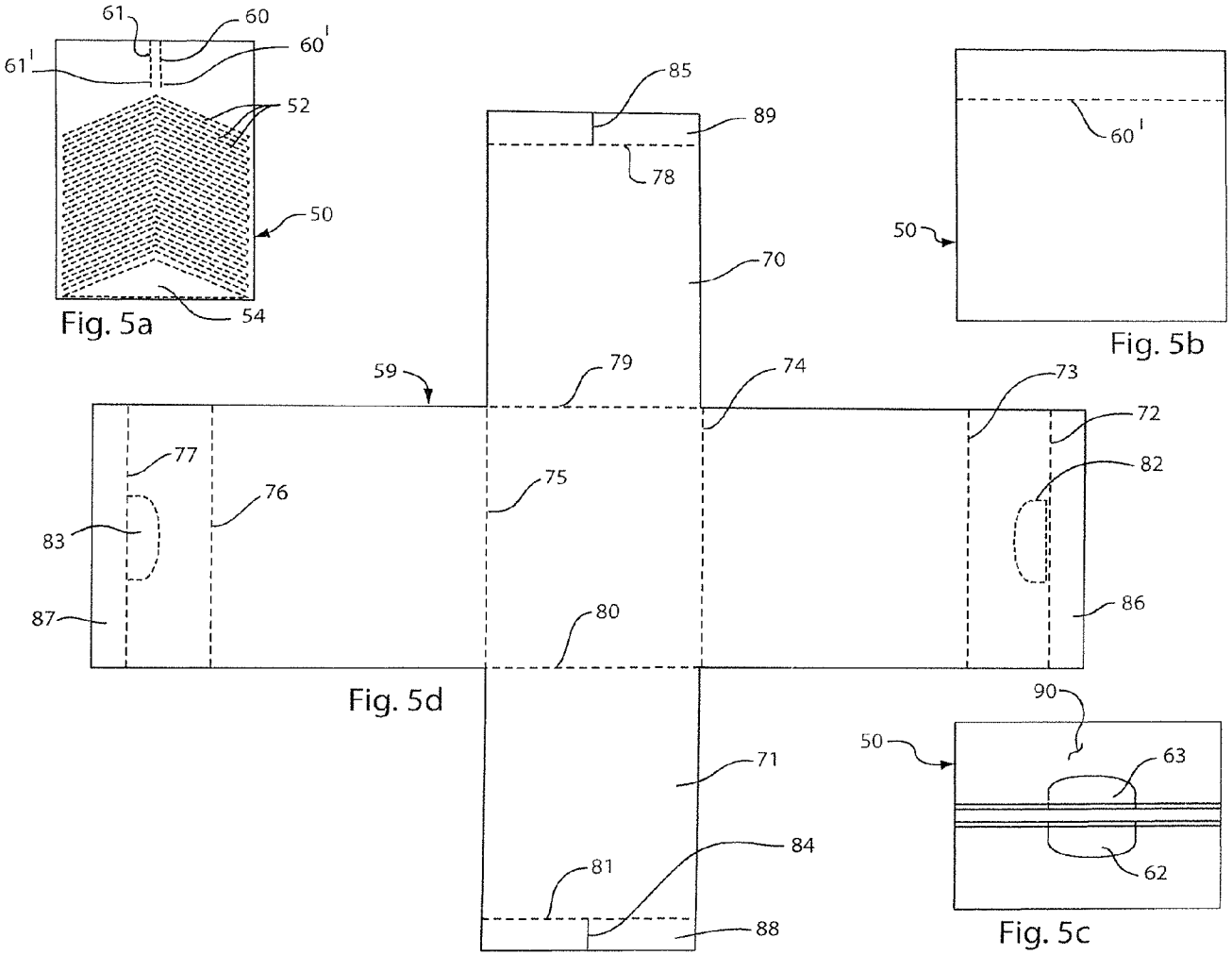

FIGS. 5*a*, 5*b*, and 5*c* show end, side, and top views, respectively, of a package of specialty shingles according to another embodiment of the present invention.

FIG. 5*d* shows a plan view of unassembled packaging of the invention shown in FIG. 2*a*.

FIGS. 6*a*, 6*b*, 6*c*, and 6*d* show steps in the assembly of a plurality of packages of specialty shingles including a box tray according to an embodiment of the invention.

Figure 7B:
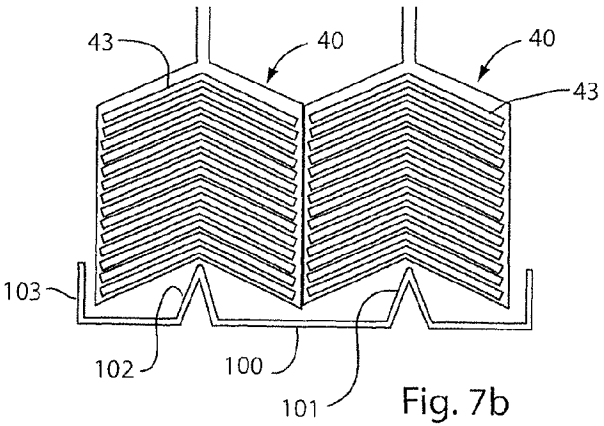
Figure 7C:
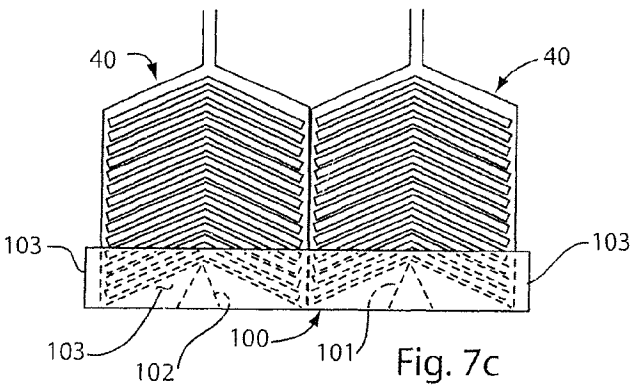
Figure 7A:
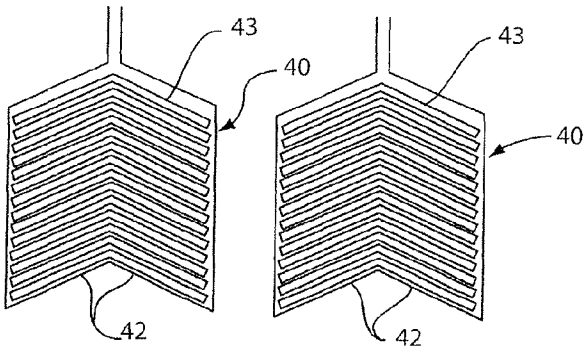
Figure 7A:
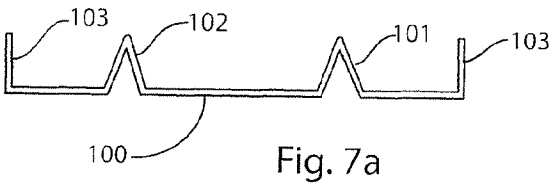

FIGS. 7*a*, 7*b*, and 7*c* show end views of assembly stages of a plurality of packages of specialty shingles, including a box tray according to another embodiment of the invention.

Figure 8:
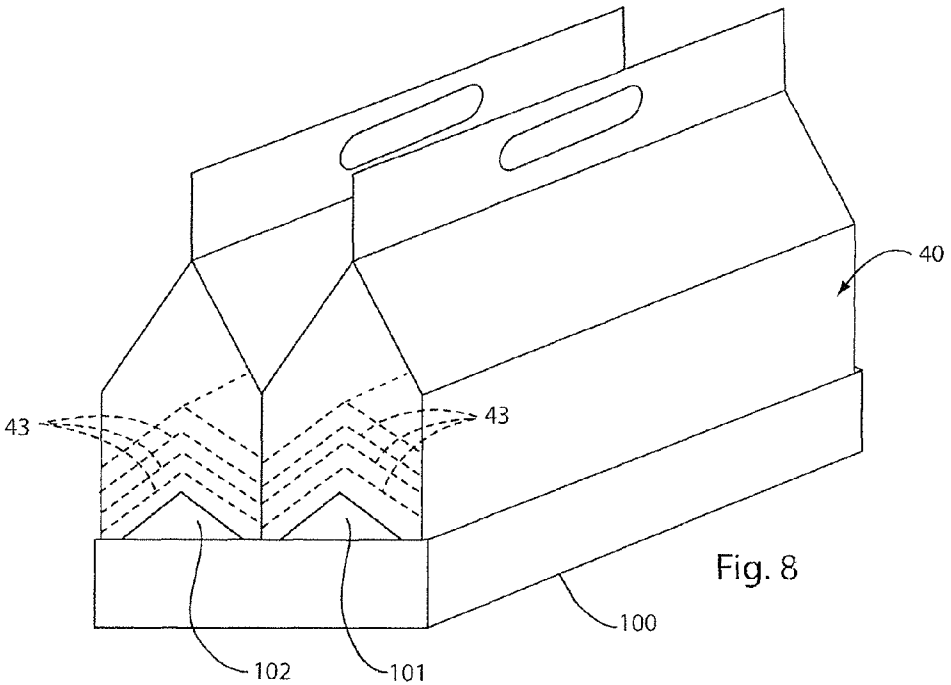

FIG. 8 shows a perspective view of a pair of packages of specialty shingles in a box tray as in FIG. 7.

Figure 9B:
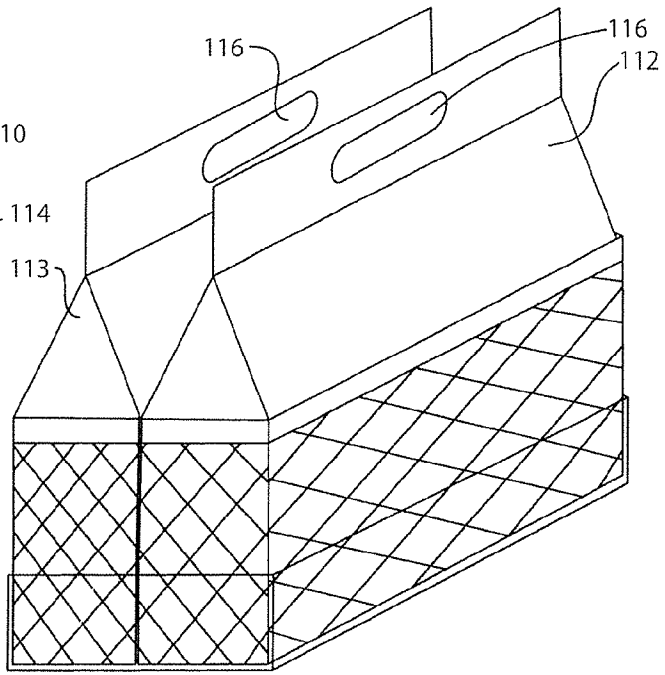
Figure 9A:
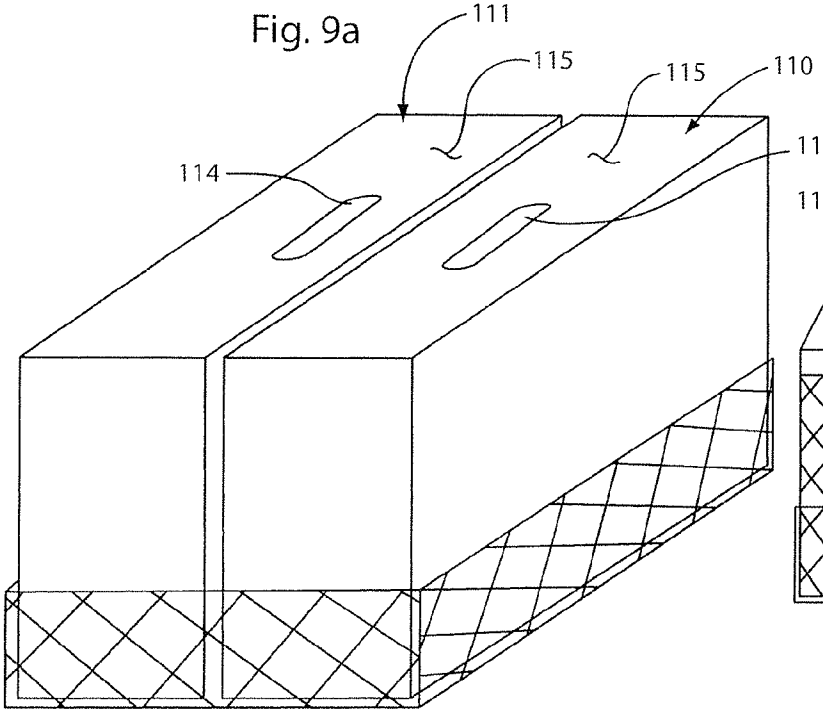

FIGS. 9*a* and 9*b* show pairs of alternative packages of specialty shingles in box trays.

Figure 10A:
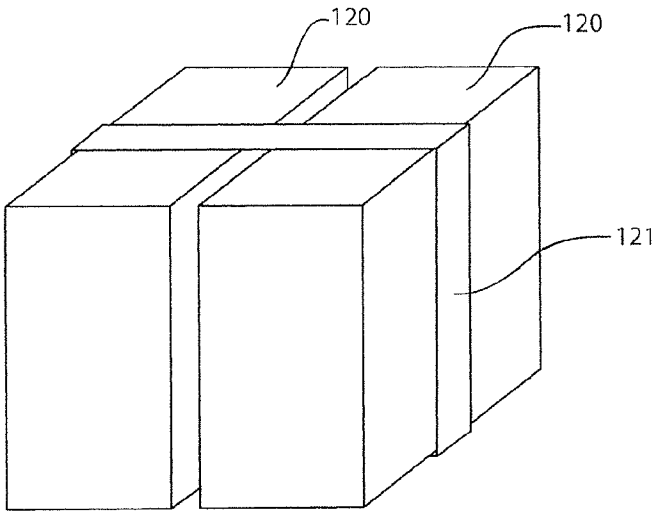
Figure 10B:
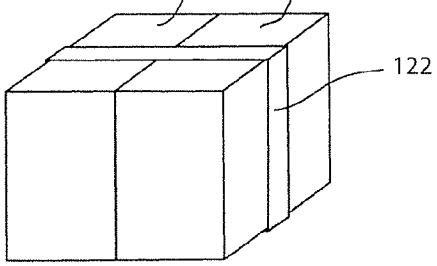
Figure 10C:
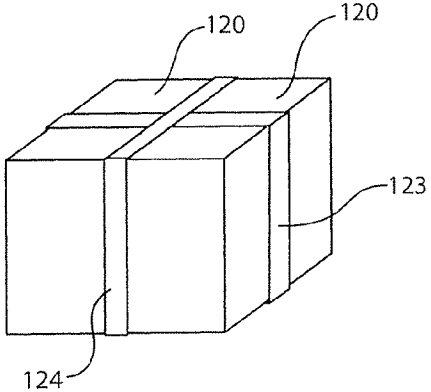

FIGS. 10*a*, 10*b* and 10*c* show perspective views of packages of specialty shingles with tension straps.

Figures 11A, 11B, 11C:
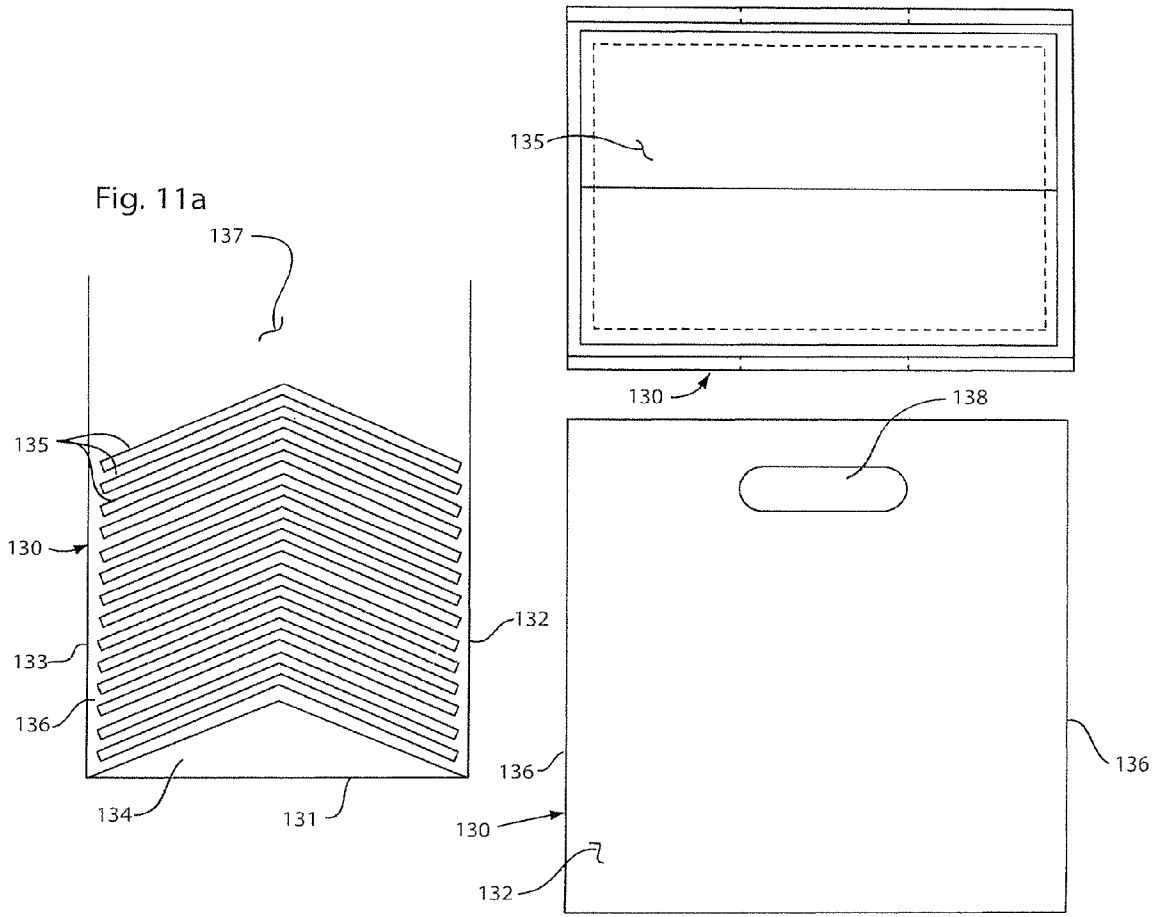

FIGS. 11*a*, 11*b*, and 11*c* show end, side, and top views, respectively, of a package of specialty shingles according to another embodiment of the present invention.

Figure 12:
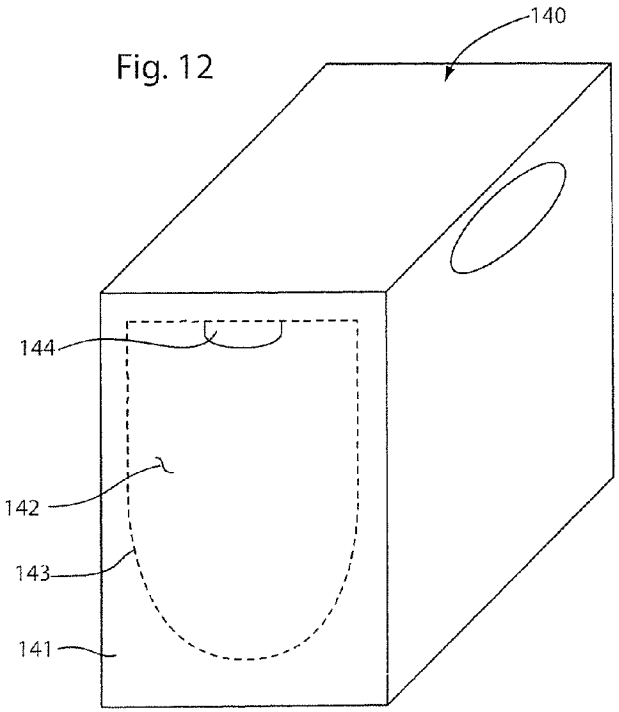

FIG. 12 shows a perspective view of a package of specialty shingles according to another embodiment of the present invention.

Figures 13A, 13B, 13C:
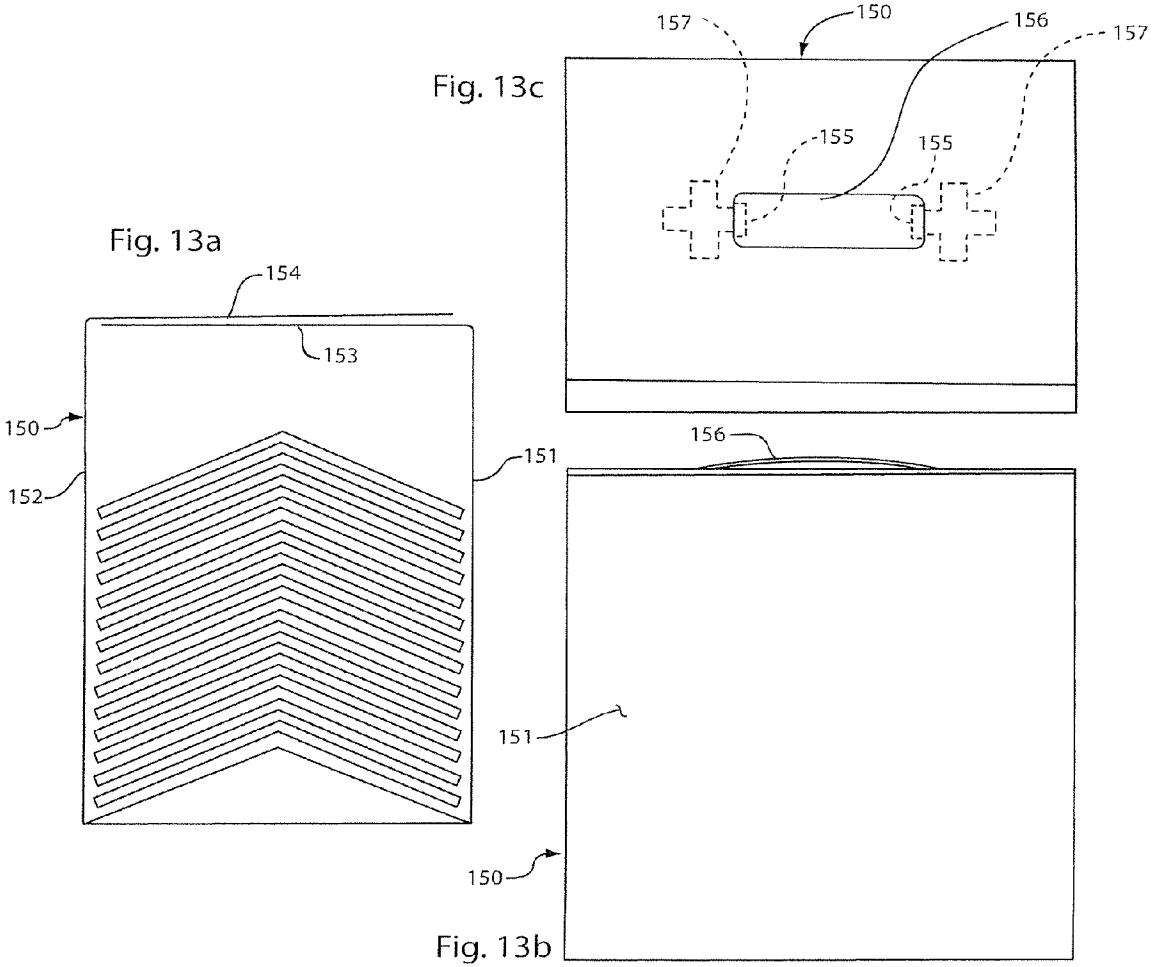

FIGS. 13*a*, 13*b*, and 13*c* show end, side, and top views, respectively, of a package of specialty shingles according to another embodiment of the present invention.

Figure 14B:
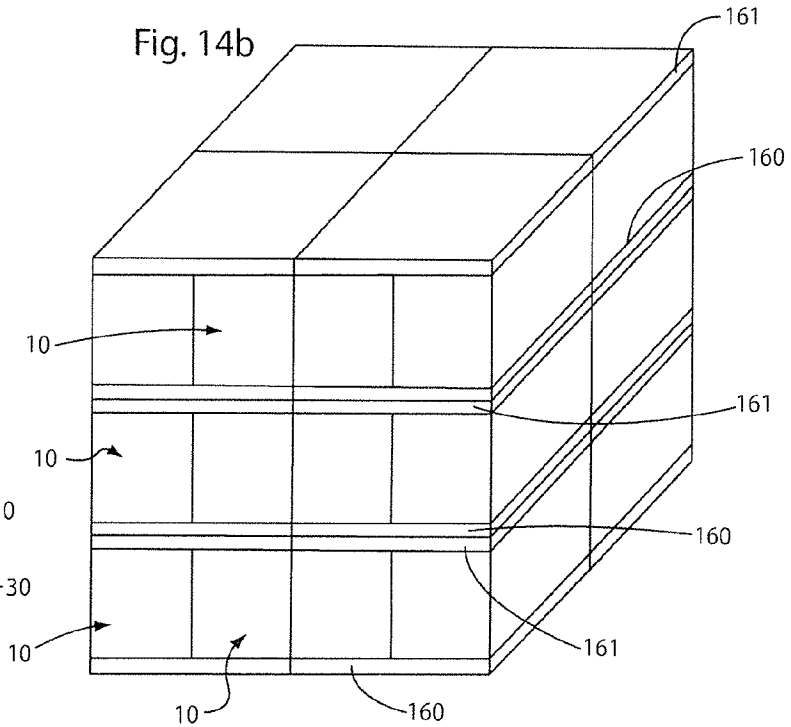
Figure 14A:
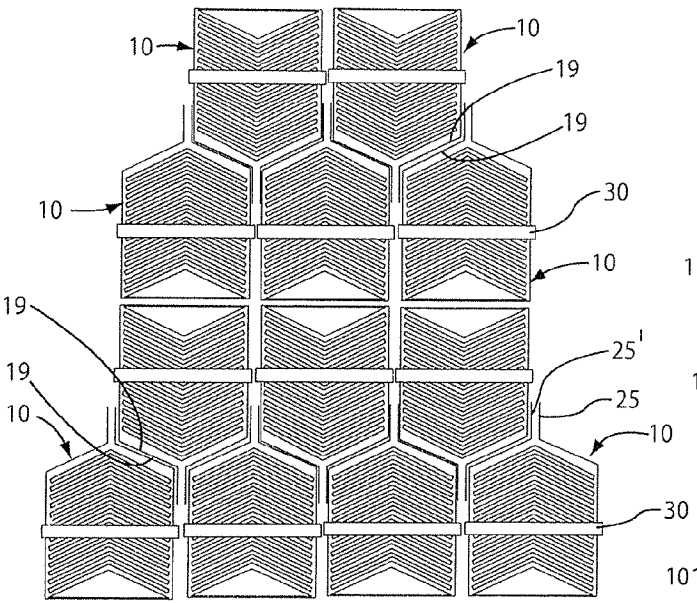

FIG. 14*a* shows an end view of a stacked pallet load of packages of specialty shingles according to an embodiment of the present invention.

FIG. 14*b* shows a perspective view of a stacked pallet load of packages of specialty shingles according to another embodiment of the present invention.

Figure 14D:
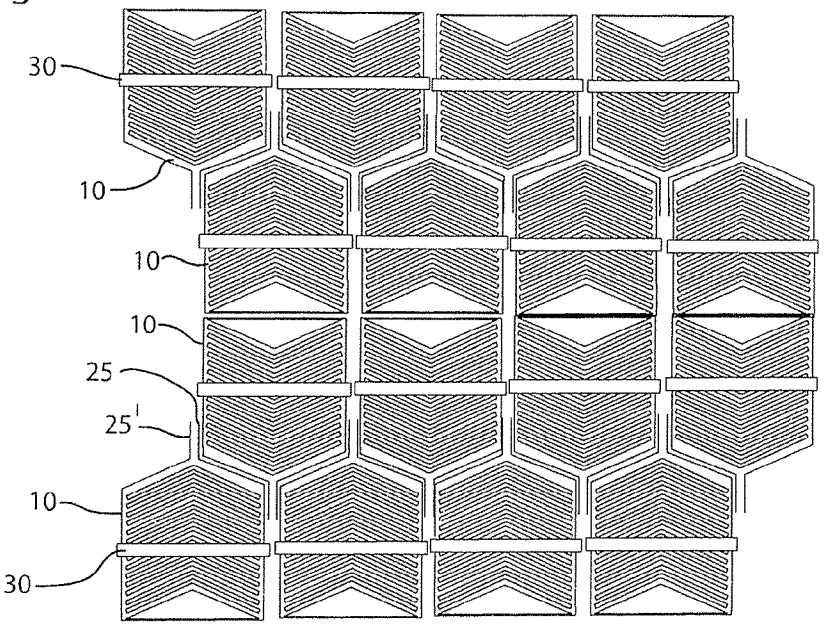
Figure 14C:
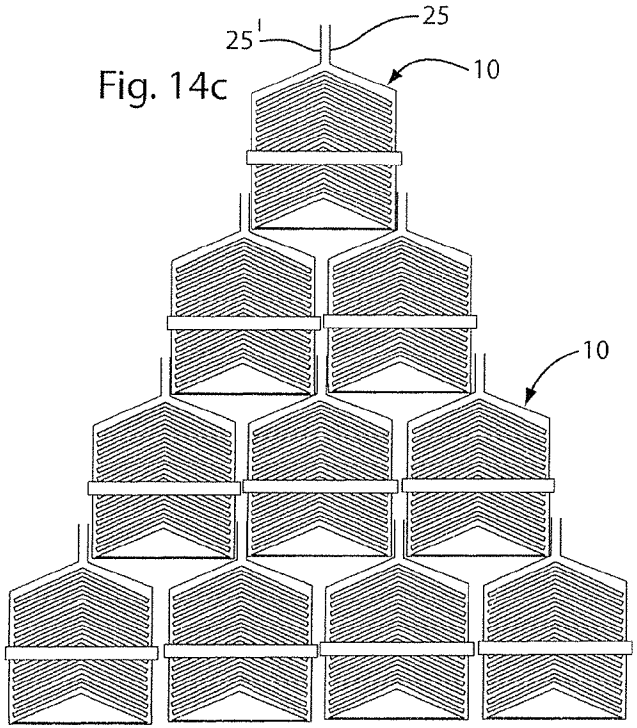

FIG. 14*c* shows an end view of a stacked pallet load of packages of specialty shingles according to another embodiment of the present invention.

FIG. 14*d* shows a top view of a layer of shingles arranged for a pallet of packages of specialty shingles according to another embodiment of the invention.

Figure 15B:
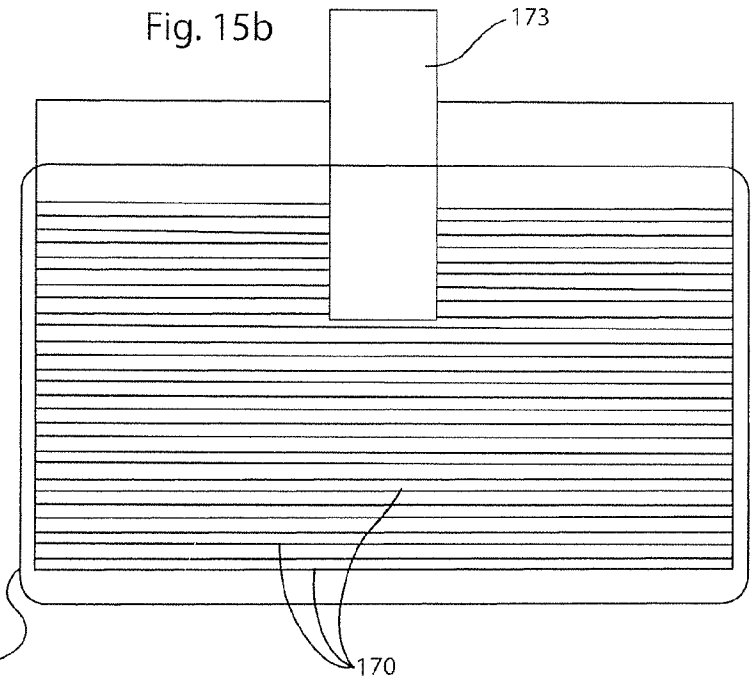
Figure 15A:
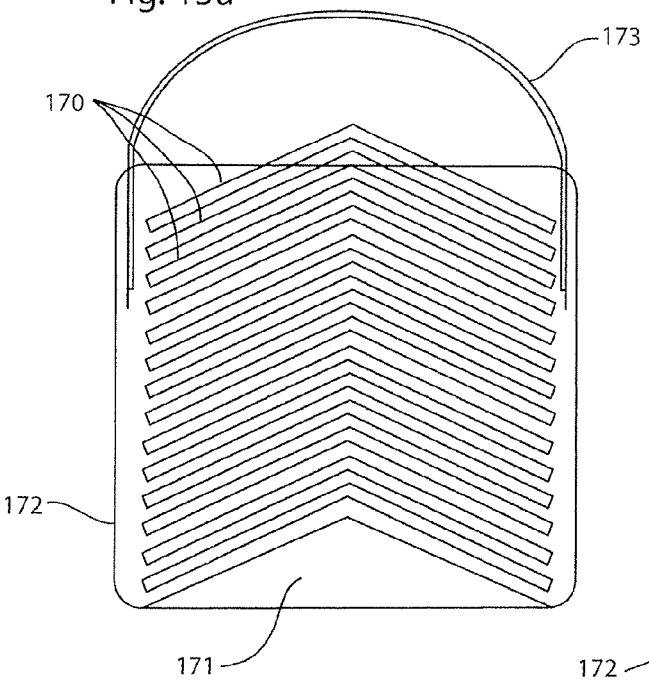

FIGS. 15*a* and 15*b* show end and side views, respectively, of a package of specialty shingles, including a plastic wrap according to another embodiment of the invention.

Figure 16B:
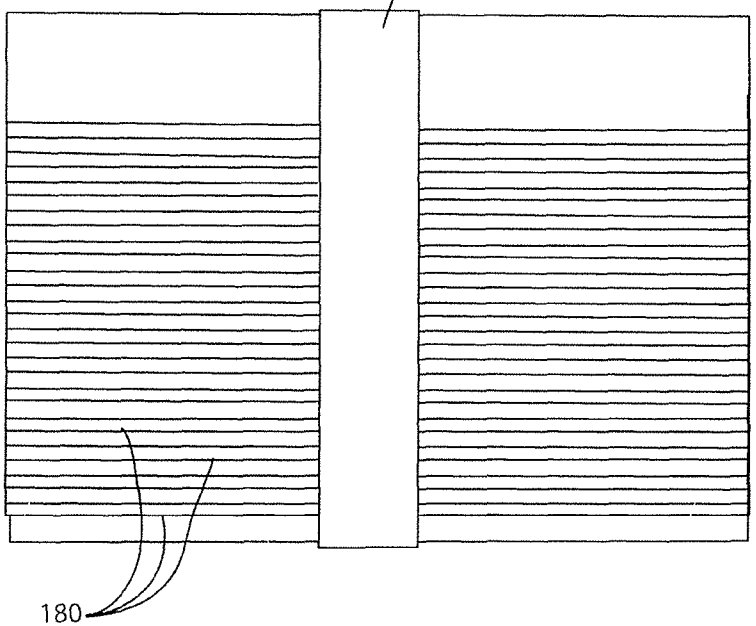
Figure 16A:
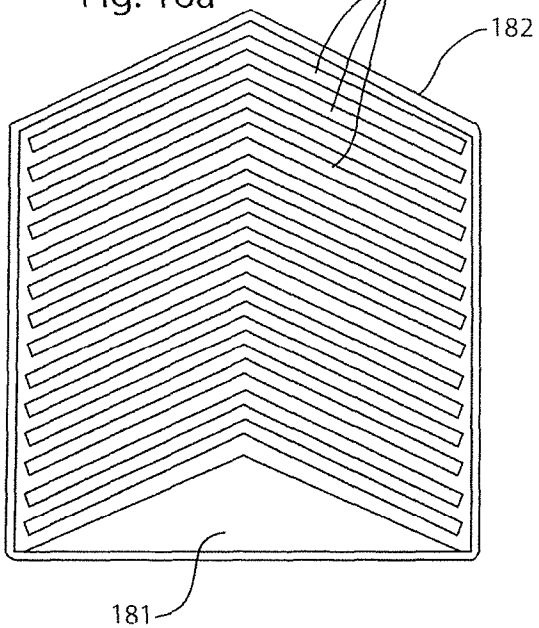

FIGS. 16*a* and 16*b* show end and side views, respectively, of a package of specialty shingles, including a constraining band according to another embodiment of the invention.

FIG. 17 shows an end view of a stacked pallet load of packages of specialty shingles according to another embodiment of the present invention.

DETAILED DESCRIPTIONS OF THE PREFERRED EMBODIMENTS

Referring now to the drawings in detail, reference is first made to FIG. 1*a*, wherein the package 10 of specialty shingles 11 is shown in perspective. A stack 12 of hip and ridge shingles 11 is contained in a package 10 having a bottom wall 13 and two side walls 14 and 15. The ends 16, 17 of the package 10 are open. The two sidewalls extend above the stack of hip and ridge shingles and are folded at 18, 20 and 18', 20' to come together, meeting at the peak 21 of the stack 12 of hip and ridge shingles and extending further upwardly. Apertures 22 and 22' provided in the upwardly extending portions of the side walls 14, 15, where they have come together, so as to provide a hand hold for lifting and carrying the package 10 of specialty shingles. A support insert 23 is included in the package 10 beneath the stack of shingles with a shape complementary to the lower surface of the bottom hip and ridge shingle.

FIG. 1*b* shows another view of the package 10 of FIG. 1*a*, but with a constraining means 24 provided around the sidewalls of the package 10 at the level of the shingles within the package. In a preferred embodiment, this constraining means 24 is made of a shrink wrap packaging material. In yet another embodiment, it could be another wrap material such as a kraft paper, or plastic or poly wrap, or the like, with overlaps joined by an adhesive to secure the wrap to the package. The constraining means provides a force to maintain the geometry of the package and retain the contained specialty shingles in their preferred shape.

FIGS. 2*a* and 2*b* show an end view and a side view, respectively, of a package 10 of specialty shingles 11 similar to that of FIGS. 1*a* and 1*b*. The shingles 11 are shown stacked one on top of another and visible through the open end 16 of the package 10. The handle feature 22 is shown where the upper portions of the side walls have been folded toward one another over the stack 12 of shingles 11. An inverted V-shaped support 23 is shown to assist in maintaining the shape of the hip and ridge shingles 11 contained within the package 10. In some instances, for example when the hip and ridge shingles have a tapered shape and are thicker at one end and thinner at the other, the support structure may take on a canted prismoidal shape as described, for example, in US patent application US20070267306A1. Also, as described in the same application, the shingles 11 in the stack 12 may all be aligned in the same direction front to back, or may alternate orientation either from shingle to shingle, or in groups of shingles so as to maintain a stack 12 of even height from front to back. FIG. 2*c* shows an unassembled packaging element in extended form. Fold lines 18, 20, 26 and 18', 20' and 26' and handle aperture cutouts 22 and 22' are depicted.

While it is preferred that the packaging element shown discussed thus far would have sufficient rigidity to contain and maintain the shape of the package 10 when filled with hip and ridge shingles 11, it recognized that in some instances, hip and ridge shingles 11 may have a degree of pliability and flow to them and may relax their shape over time, and distort from the preferred shape for easy installation to the angled feature of the roof top.

FIGS. 2*d* and 2*e* show an end view and a side view, respectively of an embodiment of a package of specialty shingles 11 analogous to that of FIGS. 2*a* and 2*b*, but where a constraining means is provided in the form of a band or strap 30. The band 30 maintains the shape of the package 10 containing the shingles 11 so as to prevent flow and distortion of the shingles during storage or handling and resists self-opening of the package 10. Packaging bands 30 of plastic, metal, paper, cardboard, fabric, tapes, or other known materials may be employed. The packaging element 10 covering the bottom, two sides and top of the stack 12 of shingles 11 provides useful protective packaging that aids in transportability and handling of the package, while requiring less material than a conventional box.

FIGS. 2*f* and 2*g* depict packaging 10 of a stack 12 of specialty shingles 11 similar to that of FIGS. 2*d* and 2*e*, except that the constraining means is provided in the form of a plastic film 31. The plastic film 31 is preferably selected from the group of stretch wrap and shrink wrap films. The film may be printed with product information. Alternatively, a label including product information may be applied to the film wrapped package. In yet another embodiment, not shown, the constraining means is a wrap of paper, plastic film or foil which is secured around the package element by means of an adhesive or mechanical fastener or other fastening means. A wrap of paper or film or foil may easily be printed with appropriate product information for the installer and/or for inventory or manufacture control.

FIGS. 3*a* and 3*b* show end and side views, respectively, of another embodiment of the invention. In this case, the bottom wall 41 of the packaging element 40 includes an integral inverted V-shaped portion 42 as a part of the element. The shape of the bottom of the packaging element is adapted to conform to that of the bottom of the specialty shingles 43 to be contained within the package.

FIGS. 3*c* and 3*d* show the same packaging element 40 with the further addition of a constraining means, in this case a shrink wrap or stretch wrap film 44, although it will be understood that other constraining means will be useful to practice the invention.

FIGS. 4*a*, 4*b* and 4*c* show end, side and top views, respectively of yet another embodiment of the invention. A stack 51 of hip and ridge shingles 52 is shown visible through the end 53 of the packaging element 50. A support insert 54 is included with an inverted V-shape to assist in maintaining the geometry of the packaged shingles contained within the package. In this embodiment, the side walls 55, 56 fold toward one another at 57, 58 and then downwardly centrally at 60, 61 above the stack 51 of shingles 52. Apertures 62, 63 are present in the top of the package 50 and through the downwardly directed portions 60, 61 of the packaging element 50 so as to provide a handle means for portability of the package of specialty shingles. In a preferred embodiment, there is sufficient space in the assembled package for a hand to reach in through the apertures to hold the handle means 64 of the package 50. In another preferred embodiment, the downwardly directed portion 60, 61 of the package element making up the handle area extends sufficiently downwardly, terminating at 60', 61', to contact and stabilize the stack 51 of specialty shingles 52 therebeneath to keep the shingles from moving within the package. FIGS. 4*d*, 4*e* and 4*f* show the same package from the same views, but with the addition of a constraining means provided in the form of a tension strap or band 65. FIGS. 4*g*, 4*h* and 4*i* show a plastic wrap constraining means. Constraining means have been described above.

Yet another embodiment of the invention is shown in FIGS. 5*a* through 5*d*. FIGS. 5*a*, 5*b* and 5*c* show end, side and top views. FIG. 5*d* shows an unassembled package element 59. In this embodiment, the packaging element is provided with panels that cover the ends of the stack of specialty shingles 52 on assembly of the package element 59 into the package 50 of FIGS. 5*a*, 5*b* and 5*c*. FIG. 5*a* shows an end view with the hip and ridge shingles and the support insert 54 shown in phantom. FIG. 5*d* shows the packaging element piece 59 in plan view and includes denotations of fold lines 72-81 and cutouts 82, 83 for assembly of the package 50 from the flat package element 59. A handle aperture 62, 63 is provided. Notch cuts 84, 85 are provided so that folded top portions 88, 89 of the end panels 70, 71 can be tucked under the cover of the package provided by the inwardly folded side walls 86, 87 of the package and accommodate the downwardly directed fold of the handle portion in the top 90 of the package 50 when the package 50 is assembled from the package element 59.

Figures 6A, 6B, 6C, 6D:
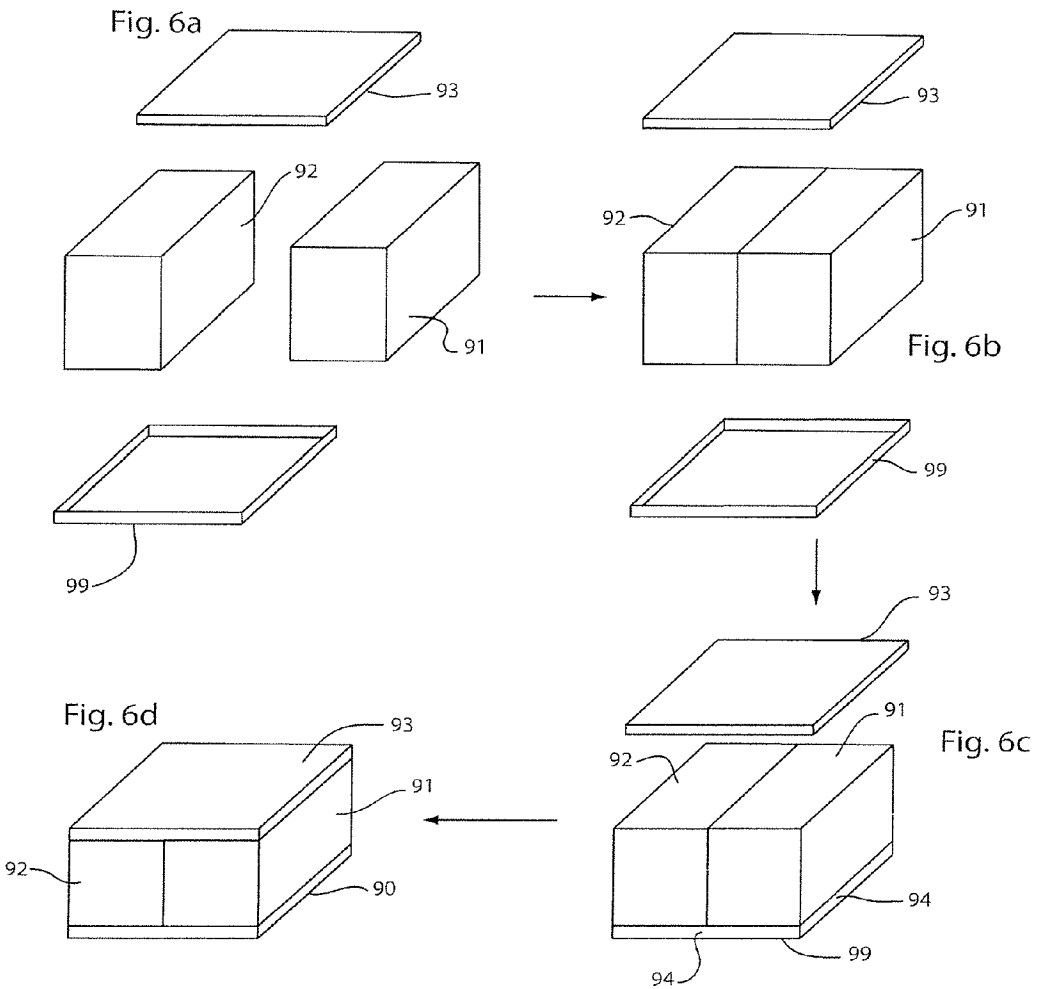

In one embodiment a box tray is used to associate two or more packages of specialty shingles as shown in FIGS. 6*a* through *d*. FIG. 6*a* shows a perspective view of a bottom box tray 99, two packages 91, 92 of specialty shingles, and an optional top box tray 93. The top box tray 93 is similar to the bottom box tray 99, but inverted in structure. In FIG. 6*b* the two packages 91, 92 of specialty shingles are brought together above the bottom box tray 99. FIG. 6*c* shows the pair of adjacent packages 91, 92 contained within the lower box tray 99, the wall 94 of the lower box tray holding the pair of packages together as a unit. FIG. 6*d* shows the optional top box tray in place, further restraining movement of the two packages of specialty shingles relative to one another so that multiple packages of specialty shingles may be easily handled as a unit. It will be understood that box trays of this sort may contain two or three or more packages of specialty shingles packaged according to other aspects of the invention to facilitate handling of the packages en masse.

FIG. 7 depicts packages 40 of shingles 43 as in FIGS. 3*a* through 3*d* in association with a lower box tray 100 of an alternate configuration. The alternate configuration includes support features 101, 102 within the box tray 100 to lend additional support to the integral support built into the packaging element 40 of FIGS. 3*a-d*. The box tray 100 makes it easier to handle multiple packages 40 simultaneously by maintaining two or more packages 40 in close association via support features 101 and 102 and tray lips 103, and, in the case of the embodiment of FIGS. 7*a*, 7*b* and 7*c*, providing additional support to prevent distortion of the three-dimensional shape of the specialty shingles 43 contained within the package.

FIG. 8 shows a perspective drawing of the packages 40 and box tray 100 of FIG. 7 with a close up view of the effect of the double support inserts 101, 102 equipped box tray 100 when it is loaded with several hip and ridge shingles 43 (shown in phantom) on each support element 101, 102. The box tray 100 with the support elements 101, 102 is also useful for temporarily storing stacks of shingles 43 outside of the package that are soon to be ready for use in installation upon a roof.

FIGS. 9*a* and 9*b* show perspective drawings of alternative embodiments of pairs of packages 110, 111, 112 and 113 of specialty shingles in box trays. In the case of FIG. 9*a*, a handle element 114 is included in the substantially planar top 115 of each package 110, 111. In the case of FIG. 9*b*, a handle element 116 is include similar to that of FIGS. 1 through 3.

FIGS. 10*a*, 10*b* and 10*c* show perspective views of pairs of packages 120 of specialty shingles as described above with the further feature of being associated with one another by means of a constraining strap or band. Various configurations 121-124 of banding are depicted. Optionally, handles may be attached to the package assemblies via the bands (not shown).

FIGS. 11*a*, 11*b*, and 11*c* show yet another embodiment of the invention in end, side, and top views, respectively. In this embodiment, the packaging element 130 has a bottom support panel 131 and upwardly directed side panels 132, 133. A support insert 134 for the hip and ridge shingles 135 is included. Handle apertures 138 are included in each of the side panels 132, 133. An optional constrainment feature such as, for example, a band, strap, stretch wrap, shrink wrap, paper or plastic wrap, may also be employed (not shown). The end 136 of the packaging element is open. The top 137 of the packaging element is open. An economy of materials is employed relative to a conventional box.

FIG. 12 shows another embodiment of the invention where the packaging element 140 includes panels 141 that cover at least an end of the package. At least one of the end panels 141 includes a tear out or removable means 142 so that the package can be easily opened to access the specialty shingles therein. Such removable means may be effected by pre-perforation 143 of the end 141 of the package material 140. Zip-strips or pull cords or strings (not illustrated) may also be employed to create an easily openable section of the end of the package. In the case of a tear out section or pull string, a notch 144 may be provided to give easy access to start the tear of pre-established perforations or to engage the pull string to create the opening in the package to access the shingles within.

FIGS. 13*a*, 13*b* and 13*c* show yet another embodiment of the packaging 150 of the invention. In this case, each of the two upwardly directed side walls 151, 152 have additional length and a foldover 153, 154 so as to engage one another in an overlapping manner, thus closing the top of the package with overlapping top panels 153, 154. Apertures 155 are provided in the top to receive a handle 156, for example a plastic box handle with optional support plates or washers (such as the phantom illustrations in cruciform configuration 157 shown in FIG. 13*c*) as are available from Allen Field Company, Farmingdale, N.Y. (www.allenfield.com). The packaging element 150 may be closed at the top by means of an adhesive, tape, or mechanical fastener such as, for example, a staple, or, alternatively, by means of engagement with a plastic box handle element that traverses through the top panels of the packaging element.

It will be understood that alternate box handles are available that may be suitable for use with the packaging of the invention in its various configurations. For example, box handles and handle reinforcements are disclosed in U.S. Pat. No. 5,462,221 and U.S. Pat. No. 5,467,915, each of which is hereby incorporated in its entirety herein. Additional exemplary package handle accessories that may be useful with various aspects of the invention are available through PackAndSeal.com, Avenel, New Jersey, and Plastic Handles and Accessories, Vaudreuil-Dorion, Quebec, Canada.

FIG. 14*a* shows an end view of a configuration for stacking packages of the invention for storage, for example, on a pallet (not shown). In this embodiment of a stack of packages, the packages 10 such as those depicted in, for example, FIG. 2*d* with each overlying layer of packages 10 inverted relative to an underlying layer. The upwardly directed handle portions 25, 25' of the packages in the first layer of the stack fit in between adjacent packages in the next vertically adjacent layer in the stack. For inverted packages in the second layer of the stack, the sloped top 19 of the package and the handle means nest within the sloped top 19 and handle means 25, 25' of the underlying layer of the stack. The top surface of the second layer of the stack is again flat as is the base, albeit narrower in pyramid fashion. The third layer of the stack is in upright arrangement as it is put in place. The fourth layer is again inverted and, as before with the lower layers, the tops of the packages nest in interlocking engagement to stabilize the loaded stack (not illustrated). An optional banding or wrapping of the stack may be employed to further stabilize the stack of packages, for example for pallet transport and the like.

FIG. 14*b* shows a perspective view of another embodiment of the invention where the packages 10 of shingles are equipped with lower and upper box trays 160, 161 that associate pairs of packages in units of two, and the packages are stacked three high, two units wide and two units deep for storage or for transport as, for example, on a pallet (not illustrated).

FIG. 14*c* shows an end view of another arrangement of the invention where the packages 10 having upwardly directed handles are stacked such that the upwardly directed handles 25, 25' of a lower layer of packages are nested in between adjacent packages of a next adjacent upper layer of packages. In this case, all packages are uprightly disposed in the stack.

FIG. 14*d* shows a top view of a further embodiment of the invention wherein a layer of packages 10 is depicted, the packages 10 having upwardly directed handle means 25, 25', sloped upper surfaces leading from the side walls to the handle means, support inserts within the package, and a constrainment means 30, as shown in FIG. 2*d*. In this case the packages 10 are oriented on end such that the shingles within the package are vertically aligned. This configuration presents a planar arrangement for the stacking of a subsequent layer of packages of specialty shingles on top of the first layer, for example, for storage or transport on a pallet.

FIGS. 15*a* and 15*b* show an end view and side view of another embodiment of the invention where a stack of a plurality of specialty shingles, such as, for example, hip and ridge shingles 170, is placed on a support structure 171 and stabilized for packaging using a constraining means. In this case, the constraining means shown is either via shrink wrapping or stretch wrapping with a plastic film 172. An optional handle element 173 is included in the packaging to facilitate transport.

FIGS. 16*a* and 16*b* show an end view and a side view of another embodiment of the invention where the stack of specialty shingles 180 on a support structure 181 is stabilized by a constraining means comprising a band or strap 182. Addition of a handle feature is optional (not shown).

The embodiments disclosed in FIGS. 15 and 16 provide packaging and containment of specialty shingles using an economy of packaging materials. This aspect of the invention provides benefits in the area of environmental friendliness and responsibility through lower volumes of packaging materials for production, storage, shipping and handling of product, as well as providing lower levels of waste at the construction site where the products are installed.

FIG. 17 shows end views of another embodiment for stacking and storage of packages of specialty shingles of the invention. In this case packages 190 as described with respect to FIGS. 15 and 16 having a profiled top are arranged in a layer. A slip sheet or insert sheet 191 is provided having a shape complementary to the profile top surface of the arrangement of the multiple packages in the first layer. This insert sheet presents a flat surface 192 after being put in place on top of the first layer of packages. A second layer of packages is then stacked on top of the insert sheet on top of the first layer of packages. A second insert sheet is provided to build up the stack. FIG. 17 depicts an example where four layers of packages with protective, supportive insert sheets 191 are stacked. The insert sheet accommodates the topography of the upper portion of the underlying packages and provides a flat base for a subsequent layer of packages to be stacked thereupon.

It is preferred that materials making up the various packaging elements of the invention include recycled content.

Various modifications can be made in the details of the various embodiments of the processes, compositions and articles of the present invention, all within the scope and spirit of the invention, as defined in the appended claims.

What is claimed is:

1. A package of specialty shingles comprising a container for specialty shingles; the container having an interior with a bottom and an upper end adapted to receive specialty shingles through the upper end; the container having a bottom wall and sidewalls foldably connected to the bottom wall; a shaped support at the bottom of the container; a plurality of specialty shingles each of an inverted V-shaped configuration with sloped upper surfaces in a nested stack in the container, each sidewall having an upper end terminating in a fold line, with a closure panel extending from each said fold line and comprising means for closing the upper end of the container when specialty shingles are disposed therein; said closure panels being sloped to be generally parallel to the sloped upper surfaces of the specialty shingles; with said closure panels terminating in additional fold lines generally above a center of the inverted V-shaped configuration of the uppermost shingle in the stack; which shingles have a degree of pliability with a tendency to relax their shape over time; with the specialty shingles having shapes at their lower ends and the shaped support having a shape at its upper end that is complemental to the shapes of the lower ends of the specialty shingles; wherein the container has upstanding handle panels at its upper end extending upwardly from the addition fold lines and wherein the handle panels have handle cutouts; shape constraining means separate from the container sidewalls disposed about the container for supporting the sidewalls of the container when a plurality of specialty shingles are disposed in the container and for providing a force that resists the tendency of the inverted V-shaped shingles to relax their shape over time and to maintain the stack of inverted V-shaped shingles in their preferred shape; wherein the shape constraining means includes any of:

(a) a mesh wrapped around at least sidewalls of the container;

(b) a shrink-wrap film wrapped around at least sidewalls of the container;

(c) a stretch-wrap film wrapped around at least sidewalls of the container; and (d) at least one band wrapped around at least sidewalls of the container.

2. The package of claim 1, wherein the specialty shingles comprise hip, ridge or rake shingles.

3. The package of claim 1, wherein the shaped support is a separate element disposed in the container, against the bottom wall of the container.

4. The package of claim 1, wherein the shaped support comprises a shaped portion of the bottom wall of the container.

5. The package of claim 1, wherein the container has at least one open end.

6. An assembly of packages of specialty shingles in accordance with claim 1, including a bottom tray containing a plurality of packages of specialty shingles, the tray having a generally horizontal flat bottom and upstanding walls, for receiving said plurality of packages therein, disposed on the tray.

7. The assembly of claim 6, including an additional tray disposed on top of the assembly of packages that are disposed in the bottom tray.

8. The assembly of claim 6, wherein each package includes a shaped support that comprises a shaped portion of the bottom wall of its associated container, and wherein the bottom tray includes a plurality of shaped portions that are complementally configured for nesting and supporting relation to the shaped supports of the packages.

9. A pallet assembly comprised of a plurality of containers according to claim 1, disposed in stacked relation on a pallet.

10. The pallet assembly of claim 9, wherein there are a plurality of horizontal levels of packages in the pallet assembly, with upstanding handle portions of packages in a given horizontal level being disposed between packages in adjacent levels.

11. The pallet assembly of claim 10, wherein packages in alternate horizontal levels are inverted so that their handle portions are downwardly extended.

12. The pallet assembly of claim 10, wherein all packages in various horizontal levels have their handle portions disposed in upstanding relation.

13. The pallet assembly of claim 10, wherein means are provided securing together the packages in the pallet assembly.

14. The pallet assembly of claim 13, wherein there is disposed about the assembly, any of:

(a) a mesh wrapped around the pallet assembly;

(b) a shrink-wrapped film wrapped around the pallet assembly;

(c) a stretch-wrap film wrapped around the pallet assembly; and (d) at least one band wrapped around the pallet assembly.

* * * * *